US005844538A

United States Patent [19]

Shiraki et al.

[11] Patent Number: 5,844,538

[45] Date of Patent: Dec. 1, 1998

[54] ACTIVE MATRIX-TYPE IMAGE DISPLAY APPARATUS CONTROLLING WRITING OF DISPLAY DATA WITH RESPECT TO PICTURE ELEMENTS

[75] Inventors: Ichiro Shiraki; Manabu Matsuura, both of Tenri; Yasushi Kubota, Sakurai; Hiroshi Yoneda, Ikoma; Yoshitaka Yamamoto, Yamatokoriyama, all of Japan

[73] Assignee: Sharp Kabushiki Kaisha, Osaka, Japan

[21] Appl. No.: 363,218

[22] Filed: Dec. 23, 1994

[30] Foreign Application Priority Data

Dec. 28, 1993 [JP] Japan ..... 5-335889
Dec. 13, 1994 [JP] Japan ..... 6-309236

[51] Int. Cl.[6] ..... G09G 3/36

[52] U.S. Cl. ..... 345/98; 345/87; 345/98; 345/100; 349/139; 349/173; 348/792

[58] Field of Search ..... 345/97, 87, 98, 345/90, 208, 99, 100; 348/792; 349/173, 37, 118, 43, 139

[56] References Cited

U.S. PATENT DOCUMENTS

| | | | |
|---|---|---|---|
| 4,432,610 | 2/1984 | Kobayashi et al. | 359/59 |
| 4,532,506 | 7/1985 | Kitazima et al. | 345/90 |
| 4,781,437 | 11/1988 | Shields et al. | 359/85 |
| 4,870,396 | 9/1989 | Shields | 345/90 |
| 4,927,243 | 5/1990 | Taniguchi et al. | 345/97 |
| 5,058,994 | 10/1991 | Mihara et al. | 345/97 |
| 5,111,195 | 5/1992 | Fukuoka et al. | 345/204 |
| 5,151,689 | 9/1992 | Kabuto et al. | 345/103 |
| 5,165,075 | 11/1992 | Hiroki et al. | 359/59 |
| 5,172,107 | 12/1992 | Kanno et al. | 345/100 |
| 5,194,974 | 3/1993 | Hamada et al. | 359/59 |
| 5,345,250 | 9/1994 | Inoue et al. | 345/100 |
| 5,365,284 | 11/1994 | Matsumoto et al. | 348/793 |
| 5,404,074 | 4/1995 | Watanabe et al. | 313/495 |
| 5,404,235 | 4/1995 | Okada | 345/87 |
| 5,602,562 | 2/1997 | Onitsuka et al. | 345/101 |

FOREIGN PATENT DOCUMENTS

| | | |
|---|---|---|
| 61-4114/1986 | 2/1982 | Japan . |
| 61-4115/1986 | 2/1982 | Japan . |
| 64-5282 | 1/1989 | Japan . |
| 2/272521 | 11/1990 | Japan . |
| 3-77915 | 4/1991 | Japan . |
| 3-77922 | 4/1991 | Japan . |
| 3-257427 | 11/1991 | Japan . |
| 4-310925 | 2/1992 | Japan . |
| 5-93922 | 4/1993 | Japan . |

*Primary Examiner*—Raymond J. Bayerl
*Assistant Examiner*—Seth D. Vail
*Attorney, Agent, or Firm*—Nixon & Vanderhye P.C.

[57] ABSTRACT

An image display apparatus can be arranged so that a picture element capacity obtains a value provides display data retention of less than 99% by writing same data to a picture element a plurality of times during 1 frame period. This makes it possible to disuse the auxiliary capacity and to improve an aperture ratio. Moreover, with the present invention, an MOS transistor arranged in each picture element as a switching element for driving the picture element, a scan signal line driving circuit and a data signal line driving circuit for transmitting a driving signal based upon display data to the MOS transistor through a data signal line and a scan signal line, and a first frame memory and a second frame memory provided outside the picture element for storing display data to be outputted to a data signal line driving circuit for 1 frame are formed on one substrate. As a result, it is possible to improve package efficiency and lower cost by using a driver monolithic technique.

14 Claims, 21 Drawing Sheets

ACTIVE MATRIX-TYPE IMAGE DISPLAY APPARATUS CONTROLLING WRITING OF DISPLAY DATA WITH RESPECT TO PICTURE ELEMENTS

FIELD OF THE INVENTION

The present invention relates to an image display apparatus having a display picture element in a matrix fashion.

BACKGROUND OF THE INVENTION

For thin panel displays, active matrix-type liquid crystal display apparatuses are known. In the active matrix-type liquid crystal display apparatus, as shown in FIG. 23, a picture element 75 is arranged in a matrix fashion so as to be formed as a picture element array 70, and the picture element array 70 is used as a display electrode substrate. As shown in FIG. 22, the picture element 75 is composed of a picture element capacity 73, which is composed of a liquid crystal capacity 71 and an auxiliary capacity 72, and a thin film transistor switching element (hereinafter, referred to as "TFT") 74, which is composed of amorphous silicon.

The picture element 75 is formed on a light-transmitting-type insulating substrate, such as a glass plate, and as shown in FIG. 22, each wiring such as a data signal line 76 and a scan signal line 77, which is connected to the TFT 74 and drives the picture element 75, is also formed on the insulating substrate. The picture element 75 is arranged in a position which is surrounded by each adjoining data signal line 76 and each adjoining scan signal line 77.

This kind of liquid crystal display apparatus displays an image with high quality, seldom limits the area of the insulating substrate to be used as the display electrode substrate, and is applicable to both reflecting and transmitting type displays. This type of display is widely put to practical use.

In a liquid crystal display apparatus it is necessary that a driving circuit for supplying a data signal and a scan signal to a picture element having a switching element be connected to a display electrode substrate.

As to a method for connecting a driving circuit to a display electrode substrate, there exists a film carrier system using a connecting film composed by forming many copper thin film lines on a polyimide resin thin film base, etc. and a COG (Chip On Glass) system for directly mounting a driving circuit on a display electrode substrate.

Recently a driver monolithic technique, which forms a driving circuit and a switching element as one unit when forming the switching element in a display electrode substrate so as to improve package efficiency of a circuit element, has been developed.

However, if a TFT of amorphous silicon, in which an amorphous silicon thin film that is generally used as a switching element is used as a semiconductor layer, the driving capacity of the film becomes insufficient, so it is hard to realize the driver monolithic technique.

Therefore, a driver monolithic technique using a TFT of amorphous silicon in which a polycrystal silicon thin film with high driving capacity is used as a semiconductor layer has been developed.

The following will discuss a general driver monolithic-type active matrix image display apparatus. As shown in FIG. 24, an MOS (metal Oxide Semiconductor) transistor using a TFT composed of polycrystal silicon forms a semiconductor layer 82 on an insulating substrate 81, and forms a gate insulating film 83 and a gate electrode 84. Next, the MOS transistor forms a source electrode 85 and a drain electrode 86 on the semiconductor layer 82, and further forms a layer insulating film 87 and metallic wiring layers 88, 89. Thereafter, the MOS transistor forms a protective film 90.

The gate electrode 84 is connected to the scan signal line 77, the source electrode 85 to the data signal line 76, and the drain electrode 86 to the liquid crystal capacity 71 and the auxiliary capacity 72. Here, opposite terminals of the liquid crystal capacity 71 and the auxiliary capacity 72 are connected to a common electrode.

In addition, each data signal line 76 is connected to a data signal line driving circuit 78 for supplying display data, and each scan signal line 77 is connected to a scan signal line driving circuit 79 for supplying a scan signal. The data signal line driving circuit 78 and the scan signal line driving circuit 79 are connected to a timing controller 80 for transmitting a timing signal to them.

As shown in FIG. 23, the timing controller 80 generates a voltage of data to be displayed on each picture element 75 and horizontal and vertical synchronizing signals for positioning at the time of displaying, etc. Display data for one horizontal period are sampled in the data signal line driving circuit 78 according to these signals, and the sampled signal is outputted to the data signal line 76 by the transmission signal generated in the timing controller 80.

Meanwhile, in the scan signal line driving circuit 79, as shown in FIG. 22, when the scan signal line 77 is in an active state, the display data which is being transmitted through the data signal line 76 are written to the liquid crystal capacity 71 by means of the TFT 74. Transmittance or reflectance of a liquid crystal layer is modulated by a charge written to the liquid crystal capacity 71 so that a picture is maintained. If a vertical frequency of display data is 60 Hz, a picture on one screen, namely, one frame, is completed in 1/30 seconds in an interlace system, and in 1/60 seconds in a non-interlace system.

Incidentally, the liquid crystal capacity 71 includes a resistance component with comparatively high resistance parallel to the liquid crystal capacity 71, and also in the TFT 74 in an OFF state, a resistance component exists. For this reason, stored charges leak out through these resistance components so that a potential of a picture element electrode changes before display data are again written to the picture element 75 for the next frame. Moreover, where the TFT of polycrystal silicon, which is indispensable in order to realize the driver monolithic technique, is used as a switching element, an OFF characteristic of the transistor is inferior to a TFT of amorphous silicon, and this causes further deterioration in quality of a picture. Therefore, in order to reduce the above malfunction, the auxiliary capacity 72 having a comparatively larger value is usually provided parallel to the liquid crystal capacity.

However, in the conventional liquid crystal display apparatus, where the TFT 74 of polycrystal silicon is used as a switching element, an OFF characteristic of the TFT 74 of polycrystal silicon is inferior to the TFT 74 of amorphous silicon, because an indicating voltage is decayed. For this reason, there arises a problem of deterioration in quality of a picture that display data written to the picture element 75 are not sufficiently maintained.

In addition, in order to reduce the above malfunction, the auxiliary capacity 72 having comparatively greater value is provided parallel to the liquid crystal capacity 71. But, the aperture ratio of the picture element 75 is lowered by the existence of the auxiliary capacity 72.

The following will discuss a drop in an aperture ratio, etc. in detail referring to FIGS. 25 and 26.

Here, "field" and "frame" in the present invention are defined as follows. Namely, frame means a single-completed image to be displayed in an image display apparatus, and field means an image which is a component of the "frame".

In an image display apparatus where picture elements are arranged in a matrix fashion represented by a liquid crystal display apparatus, since an active matrix driving system is known, the following will discuss an active matrix-type liquid crystal display apparatus.

First, a construction of an image display section will be described. As shown in FIG. 25, a plurality of data signal lines 104 and a plurality of scan signal lines 105 are provided so that the data signal lines and the scan signal lines intersect, and a picture element 106 is provided in a matrix-fashion in a section which is surrounded by adjoining two data signal lines and two scan signal lines. Each picture element is composed of a transistor TR such as TFT (a thin film transistor) as an active element, a liquid crystal capacity Cp and an auxiliary capacity Cs as required. In FIG. 25, the data signal line 104 is connected to one of the electrodes of the liquid crystal capacity Cp and the auxiliary capacity Cs through a drain and a source of the transistor TR, a gate of the transistor TR is connected to the scan signal line 105, the other electrode (common electrode) of the liquid crystal capacity Cp to a common power source line, the other electrode (common electrode) of the auxiliary capacity Cs to a common power source line or the scan signal line of the preceding stage (in FIG. 25, connected to the common electrode). Here, the data signal line 104 is connected to a data driver 102, and the scan signal line 105 to a scan driver 103.

In FIG. 25, a voltage of display data to be displayed on each picture element 106 and horizontal and vertical synchronizing signals for positioning when the data are displayed are generated in a timing control section 101, and based upon these signals, timing signals (start pulse, clock, etc.) for determining drive timing of the data driver 102 (also referred to as a source driver) and the scan driver 103 (also referred to as a gate driver) are generated. Based upon these signals, the display data for one horizontal scan period are sampled in the data driver 102, and the sampled signal is outputted to the data signal line 104 by a transmission signal generated in the timing control section 101. Meanwhile, in the scan driver 103 a scan signal for specifying a storage picture element of the display data outputted to the data signal line 104 is outputted to the scan signal line 105, and display data, which are transmitted through the data signal line 104 when the scan signal line 105 is active, are written to the liquid crystal capacity Cp through the transistor TR.

Transmittance or reflectance of a liquid crystal layer is modulated by a charge written to the liquid crystal capacity Cp and a picture is maintained. However, in the liquid crystal capacity Cp, since resistance component (leak resistance) with comparatively high resistance exists parallel to capacity component and off resistance of the element and the transistor TR exist, the stored charges leak out through the resistance. As a result, a voltage of the picture element electrode is decayed until data are again written to the picture element in the next field, thereby lowering the quality of a picture. Therefore, in order to decrease a fluctuation in a potential of the picture element electrode due to leakage current, the auxiliary capacity Cs is provided parallel to the liquid crystal capacity Cp.

FIG. 26 shows a constitutional drawing of a picture element in the case where the auxiliary capacity Cs is provided (the auxiliary capacity Cs is connected to the scan signal line of preceding stage). In FIG. 26, 104 is a data signal line, 105 is a scan signal line, 101 is a TFT, and 108 is a picture element section (aperture). A section 113 where the scan signal line is overlapped on the picture element is the auxiliary capacity Cs, and an aperture ratio is lowered for an area where the auxiliary capacity is arranged.

In addition, when an electric field with a fixed direction is applied to the liquid crystal layer, the liquid crystal capacity Cp, namely, liquid crystal is remarkably deteriorated, it is necessary to carry out alternating drive to prevent the deterioration. As to the alternating drive (inversion drive), there exists field inversion for inverting polarity per field and IH line inversion for inverting polarity per one horizontal line, but "field+1H line inversion drive" is usually used.

In addition, as shown in FIG. 27, since a parasitic capacity Cgs exists between a gate and a source of the TFT TR, a shift in a voltage occurs in the picture element electrode due to division of capacity into picture element capacity (the sum of the liquid crystal capacity Cp and the auxiliary capacity Cs) and the parasitic capacity Cgs. The shift in the voltage causes malfunction such that a voltage written to the picture element becomes (V-ΔV), where V is the display data transmitted to the data signal line and V0 is an amplitude of the scan signal line (Here, $\Delta V = V0 \cdot Cgs/(Cp+Cs+Cgs)$. This is one of the factors that causes flicker.

Therefore, liquid crystal, which can provide a higher speed operation and lower data retention (smaller leakage resistance) than a TN-type liquid crystal generally used, is used in a liquid crystal display apparatus, which adopts the above-mentioned active matrix driving system, so that a liquid crystal display apparatus adopting a field sequential scan system for maintaining the data retention of the liquid crystal by means of a buffer circuit in the picture element.

The field sequential scan system mentioned here is a coloring technique for continuously carrying out additive mixture of colors using after-image effect on eyes by displaying not less than two colors in time division. As shown in a timing chart of FIG. 28, display data are transmitted to a picture element display section in an extremely-short time τ, and the display data are displayed in remained time (TR, TG, TB).

A picture element circuit in a field sequential scan system can operate with the arrangement shown in FIG. 25, but Japanese Unexamined Patent Publication 4-310925/1992 (Tokukaihei 4-310925) discloses two methods as another arrangement of the picture element circuit.

In the first suggestion, as shown in FIG. 29, a picture element circuit is arranged so as to have a hold capacity Ch and a buffer amplifying circuit 109, and display data are transmitted to a picture element display section in extremely-short transmission time τ, as shown in the timing chart of FIG. 28, and the display data are displayed in remained time (TR, TG, TB). High input impedance of the buffer amplifying circuit 109 securely maintain the transmitted display data in the hold capacity Ch, and maintains a charge in the liquid crystal capacity Cp during a period until the next display data are transmitted, namely, during holding periods TR, TG and TB.

In the second example, a picture element circuit has an arrangement as shown in FIG. 30. The picture element circuit is arranged so as to have a buffer amplifying circuit 110 and hold capacities Cha and Chb; and, while a voltage which is held in one of the hold capacities Cha and Chb is being displayed, a charge is stored in the other hold capacities Cha or Chb. This makes it possible to alternately carry out transmission of display data to the hold capacities Cha and Chb, and writing the display data to the liquid crystal capacity Cp, so the transmission time $\tau$ can be extended to ⅓ of a field, as shown in the timing chart of FIG. 31.

However, in the conventional technique, the auxiliary capacity Cs is necessary for maintaining display data, but an aperture ratio is lowered due to this existence. Nevertheless, if a conventional driving method with an arrangement of a picture element circuit in which the auxiliary capacity Cs is used, it not only causes flicker but also lowers display data retention, thereby causing a problem in which the quality of the picture deteriorates. FIG. 32 shows display data retention in a certain picture element in the cases where a picture element circuit has and does not have the auxiliary capacity Cs. Furthermore, in the case of arrangements of a circuit shown in FIGS. 29 and 30, there arises enlargement of a size of a picture element (hindrance to high refining), and a drop in yield due to increase in a number of elements in a picture element section.

In addition, as shown in FIG. 27, in the case where a TFT is used as an active element in an active matrix driving system, a voltage shift of a picture element electrode is generated due to division of a capacity into a parasitic capacity Cgs and a picture element capacity, thereby causing malfunction that display data cannot be accurately written. Moreover, this is one of factors that causes flicker.

SUMMARY OF THE INVENTION

It is an object of the present invention to provide an image display apparatus which is capable of realizing a driver monolithic technique also in the case where polycrystal silicon TFT is used as a switching element, making up for the deficiency in an OFF characteristic of the polycrystal silicon TFT, improving an aperture of a picture element and maintaining excellent quality of an image.

In order to achieve the above object, an image display apparatus of the present invention is characterized by including a picture element section which is arranged in a matrix fashion for displaying display data. The picture element section has an auxiliary capacity for holding display data, where the retention of display data for one frame of said auxiliary capacity being less than 99% (the case of not having an auxiliary capacity is also included).

With the above arrangement, an auxiliary capacity, which has been conventionally connected to a common electrode or a scan signal line of a preceding stage, is disused in the present invention, so the image display apparatus of the present invention has a simple arrangement thereby remarkably improving an aperture ratio. Moreover, the auxiliary capacity cannot be disused, but the aperture ratio can be improved by reducing a value of an auxiliary capacity Cs. Further, display data retention can also be improved. Also, in the case where a field sequential scan system is carried out, since a conventional complicated circuit configuration is not needed, the size of a picture element circuit can be reduced (reduction in a size of a picture element), thereby making it possible to improve yield and highly refine the apparatus.

In addition, not only in the case where the auxiliary capacity is lowered, but also in the case where an OFF current of a transistor which composes a sampling circuit and a hold circuit etc. in a data driver and various circuits in the picture element section is large or the case where a parallel resistance component of a sampling condenser, a data hold condenser and other condensers is small, a fluctuation in data occurs but it can be restrained.

Furthermore, in the case a TFT is used as an active element, flicker, etc. due to a voltage shift of a picture element electrode which is caused by division of a capacity into a parasitic capacity Cgs between a gate and a source of the TFT and a picture element capacity can be restrained.

In order to achieve the above object, the image display apparatus of the present invention includes:

- a MOS transistor which is arranged on each picture element as a switching element for driving the picture element;
- a driving circuit for transmitting a driving signal based upon display data to the MOS transistor through the data signal line and the scan signal line; and
- a memory means provided outside the picture element for storing display data to be outputted to said driving circuit per one frame,
- wherein the MOS transistor, driving circuit and memory means are formed on one substrate.

With the above arrangement, the MOS transistor for driving the picture element, the driving circuit for transmitting a driving signal, and the memory means for storing display data for one frame are formed on one substrate. This makes it possible to improve package efficiency and lower cost.

The memory means is divided into at least two segment memory means. It is desirable that the following are provided:

- switching means for alternately switching an operation to storing of display data for new one frame to one of the segment memory means, and to reading out of display data for one frame stored in the other segment memory means to the driving circuit; and
- repetitive writing means for repeatedly writing the same display data to the same picture element more than twice by reading out display data for one frame stored in one of the segment memory means to the driving means during a period that display data for new one frame are stored in the other segment memory means.

In this case, display data for new one frame are stored in at least one of the two segment memory means by the switching means. Then, display data for one frame stored in one of the segment memory means are read out to the driving circuit by the switching means during a period of storing display data in the other segment memory means. The switching means alternately switches the operation to storing in and to reading out to at least two segment memory means. As a result, display data can be simultaneously stored and read out to each driving circuit.

Meanwhile, when display data for one frame stored in one of the segment memory means are read out to the driving circuit, the repetitive writing means writes the same display data to the same picture element more than twice by reading out the display data for one frame stored in one of the segment memory means to each driving circuit more than twice while storing display data for new one frame are stored by the other segment memory means.

As a result, since the same display data are repeatedly written to the same picture element while display data for the new one frame are stored, data hold time required for a picture element is shortened so retention is improved. Therefore, also in the case where a polycrystal silicon TFT is used as a switching element, it is possible to make up deficiency in an OFF characteristic of a polycrystal silicon TFT and to secure excellent quality of an image.

In addition, it is possible to disuse the auxiliary capacity of each picture element or reduce a capacity value of the auxiliary capacity. For this reason, the aperture ratio of the picture element can be improved, and a size of the picture element circuit is reduced, thereby making it possible to improve a rate of acceptable products and to refine the apparatus.

If the memory means has an arrangement of DRAM, SRAM or EEPROM, a technique of existing DRAM, SRAM or EEPROM can be utilized.

Meanwhile, in the case where an amorphous silicon TFT, in which an amorphous silicon thin film generally used as a switching element, is used as a semiconductor layer, driving capacity becomes insufficient so it is hard to realize a driver monolithic technique. However, in the case where the MOS transistor is composed by using a polycrystal silicon thin film as a semiconductor layer, its driving capacity becomes higher. Moreover, each picture element which composes the memory means and the driving circuit can be also formed monolithically by using a polycrystal silicon thin film.

Further, since display data are rewritten per not more than frame cycle, even in a memory in which a TFT of polycrystal silicon with a high leak current is used, the memory means does not require a refresh operation which is performed in a normal DRAM in order to prevent vanishing of data due to leaks. Moreover, deficiency in an OFF characteristic of the MOS transistor in which a polycrystal silicon thin film is used can be sufficiently made up by writing display data from the segment memory means to each picture element a plurality of times.

In addition, it is favorable that elements which compose an MOS transistor, a driving circuit and memory means to be formed on a substrate, are formed at a process temperature of not more than 600° C. As a result, a glass substrate with a low price and a low melting point can be used, thereby making it possible to enlarge an apparatus and to lower its cost.

For a better understanding of the nature and advantages of the invention, reference should be made to the ensuing detailed description taken in conjunction with the accompanying drawings.

BRIEF DESCRIPTION OF THE DRAWINGS

FIG. 18(*a*) shows frame inversion, FIG. 18(*b*) shows frame+1H inversion, FIG. 18(*c*) shows frame+1V inversion, and FIG. 18(*d*) shows frame+1 dot inversion.

DESCRIPTION OF THE EMBODIMENTS

The following will discuss the image display apparatus of the present invention in detail.

First, the following will discuss an example that display data is not held by an auxiliary capacity of each picture element but is held by using a memory provided outside a picture element correspondingly to each picture element.

[Embodiment 1]

The present embodiment will discuss the case where display data are written to a picture element section a plurality of times during one frame in the case of monochrome display (single color display).

Figure 2:
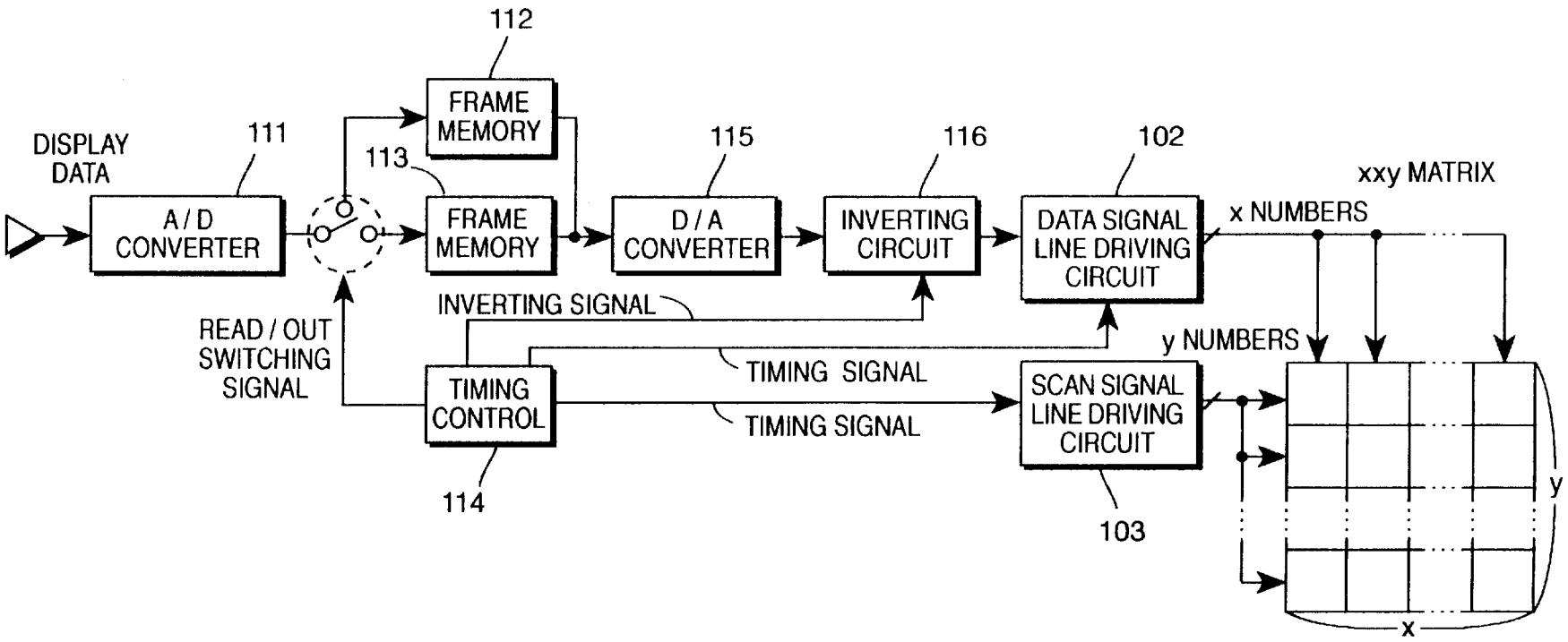
FIG. 2 is a block diagram which explains one embodiment of the present invention.

FIG. 2 shows examples of arrangements of a peripheral circuit and a picture element circuit when the driving method of the present invention is executed (in the case of X×Y matrix). In FIG. 2, 114 is a timing control circuit, 111 is an A/D converter, 112 is a frame memory, 113 is a frame memory, 115 is a D/A converter, 116 is an inverting circuit, 102 is a data signal line driving circuit, 103 is a scan signal line driving circuit and 117 is a picture element array for display (X×Y matrix). The example of the arrangement of the picture element circuit is the arrangement shown in FIG. 25 that auxiliary capacity Cs obtains a value such that display data retention is less than 99% or the auxiliary capacity Cs is eliminated. Here, the frame memory 112 and the frame memory 113 alternately write and read out display data per one field.

The following will discuss an operation. First, display data are inputted to the A/D converter 111, and after an analog signal is converted into a digital signal so as to store the display data in the frame memory, the converted signal is stored in the frame memory 112 for one frame period. At the same time, the display data before one frame period are read out from the frame memory 113 where display data have been stored serially n times during one frame period by a timing signal generated in the timing control section 114. All the display data in one field are read out within 16.67/n [msec] (in the case where a frame frequency is 60 Hz and so on). The display data read out from the frame memory 113 are converted from an analog signal into a digital signal by the D/A converter 115, and the polarity of the display data is inverted in the inverting circuit 116 by an inverting signal generated in the timing control section 114 (1H line inversion, one field inversion or field+1H line inversion, etc.). Thereafter, the inverted display data are inputted into the data signal line driving circuit 102 and are sampled therein. Then, the sampled display data are outputted to the data signal line so as to be written to each prescribed picture element.

Figure 1:
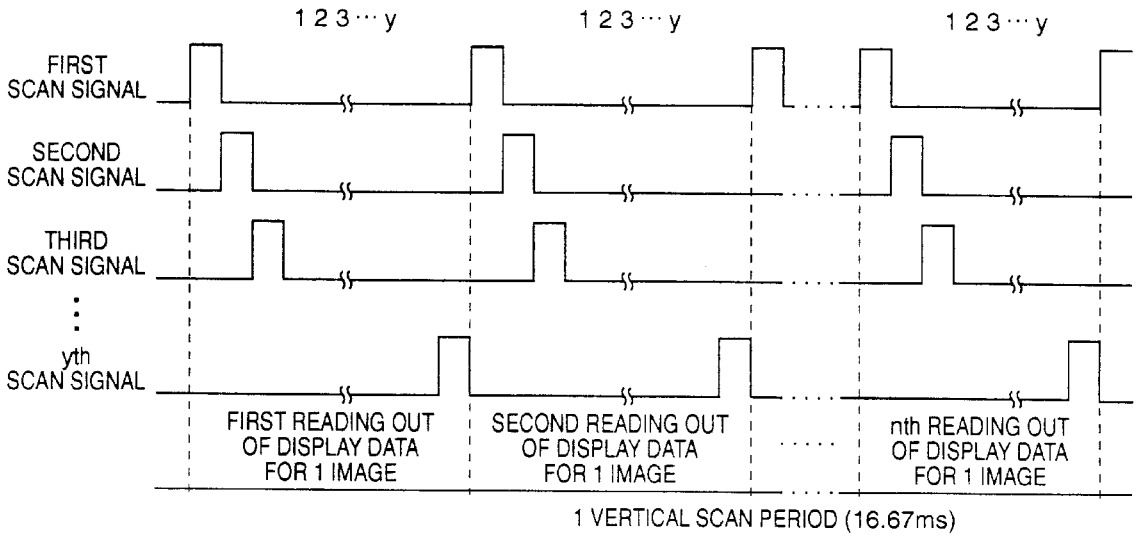
FIG. 1 is a drawing which shows an output waveform and an indicating voltage of a scan driver in a driving method of the present invention.
Figure 3:
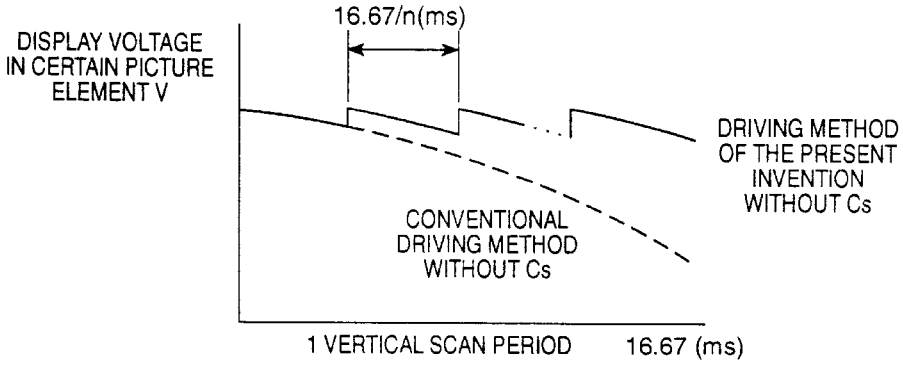
FIG. 3 is an explanatory drawing which shows display data retention in the case where the present invention is carried out.
Figure 33:
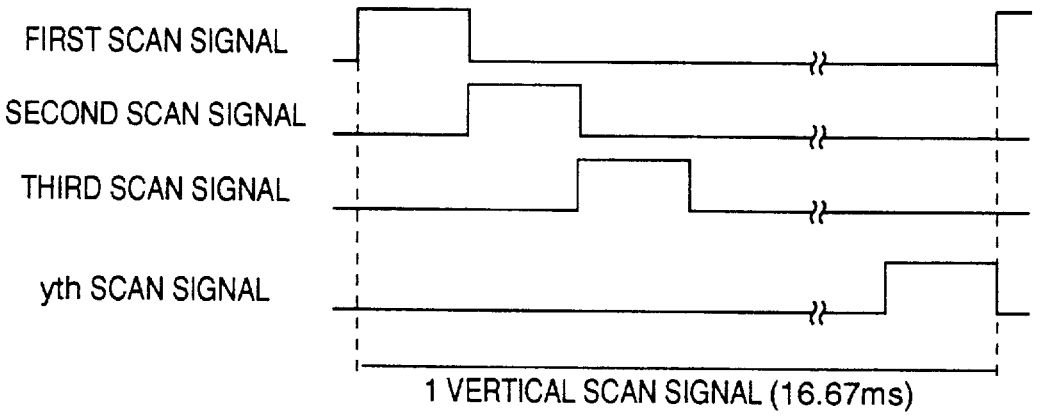
FIG. 33 PRIOR ART
FIG. 33 is a waveform diagram of an output of a scan driver in a conventional driving method.

As to timing of writing at this time (in contrast to FIG. 33 which shows one example of a conventional general scan method), as shown in FIG. 1, the scan signal line driving circuit 103 is operated at a timing which coincides with reading out of the display data from the frame memory 113 n times for one frame period (timing where y numbers of scan signals can be outputted within 16.67/n [msec]), and the data driver 102 is also operated on a frequency which makes it possible to sample and write x numbers of display data (one horizontal line picture elements) within a pulse width of each scan signal. In other words, the same display data are written to a certain picture element n times during one frame period. FIG. 3 is a graph of display data retention in a certain picture element in the case where the above operation is performed. An operation frequency of the data signal line driving circuit 102 and the scan signal line driving circuit 103 at this time (clock pulse, start pulse, etc.) is represented as n×f[Hz], wherein f[Hz] is a frequency in the case of the normal operation and n is a number of times of reading out.

As mentioned above, in the arrangement of the picture element circuit in the case where the auxiliary capacity Cs obtains a value which provides the display data retention of less than 99%, or in the arrangement of the picture element circuit in the case where the auxiliary capacity Cs is eliminated, there is an improvement in an aperture ratio, a realization of a high display data retention, and an improvement in yield and refining due to reduction in size of a picture element circuit. These are possible by using a driving method where display data corresponding to each picture element are written to a prescribed picture element n times during one frame period.

In order to write the display data to each picture element a plurality of times during one frame period, it is desirable that driving capacity of a switching element in the picture elements (transistor TR) is large and that an element having carrier mobility of at least not less than 5 $cm^2$/vsec, for example, a polycrystal silicon TFT, etc. is used.

Here, a value of 99% of the display data retention is based upon that a conventional driving method requires the data retention of not less than 99% including a margin, to stably display the display data having gradation of 64 corresponding to a practical level of natural image display for one frame period.

The above discussed non-interlace scan for writing an interlace signal whose original signal is like a TV signal to adjoining two horizontal lines (referred to also as scan lines), but the circuit arrangement is not limited to this, so it goes without saying that an arrangement that the source signal is an interlace signal and display data for image signals for two fields are displayed for one frame period is also applicable to the circuit. However, in this case, it is reasonable that an arrangement of a peripheral circuit becomes complicated or capacity of a memory increases. Moreover, in the case of spatial additive mixture of not less than two colors using a color filter, it is reasonable that the amount of circuit configurations needed increase according to a number of colors.

[Embodiment 2]

Next, the following will discuss a first embodiment of coloring in a field sequential scan system.

Figure 4:
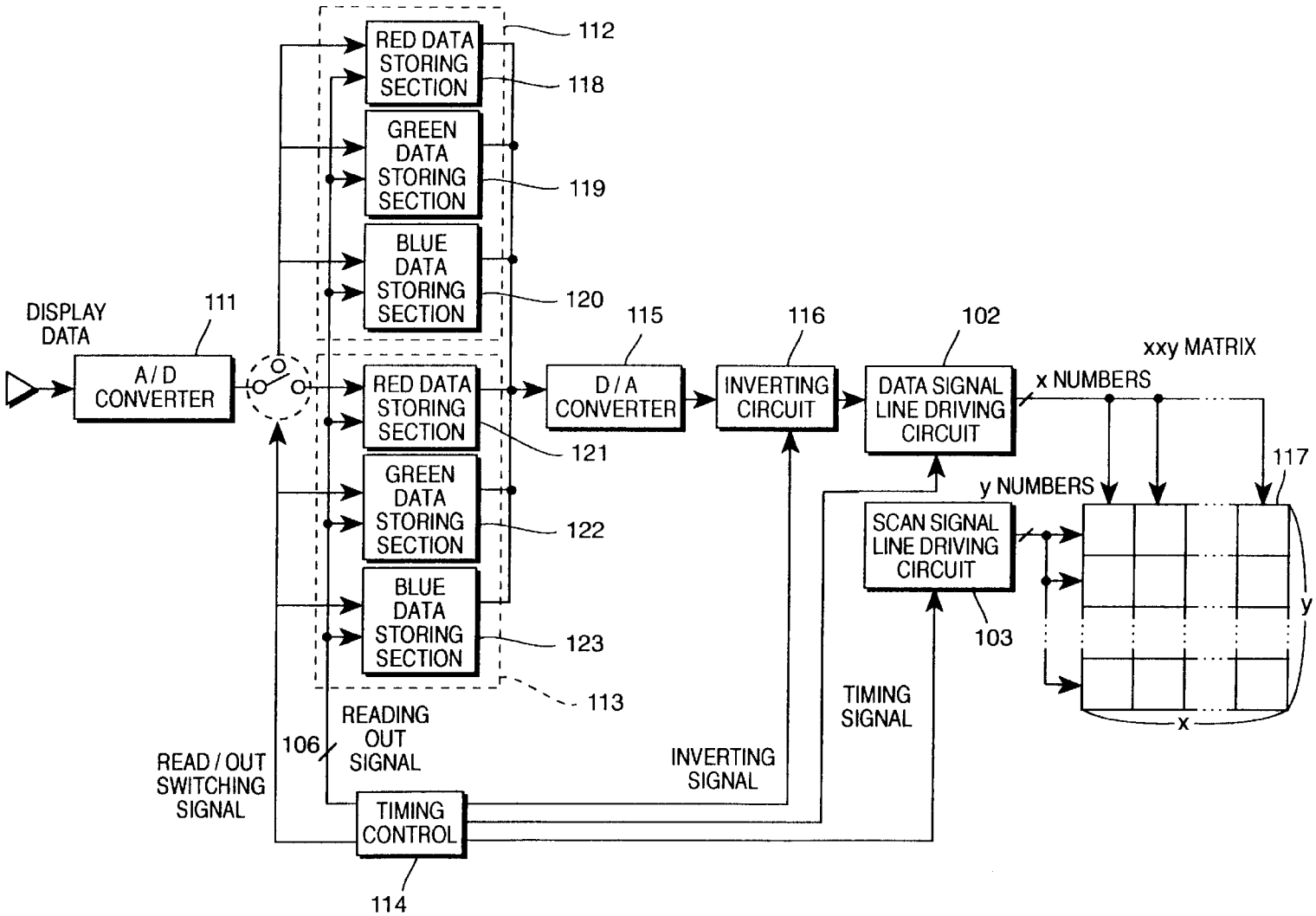
FIG. 4 is a block diagram which shows one embodiment in the case where the present invention is carried out by a field sequential scan system.
Figure 25:
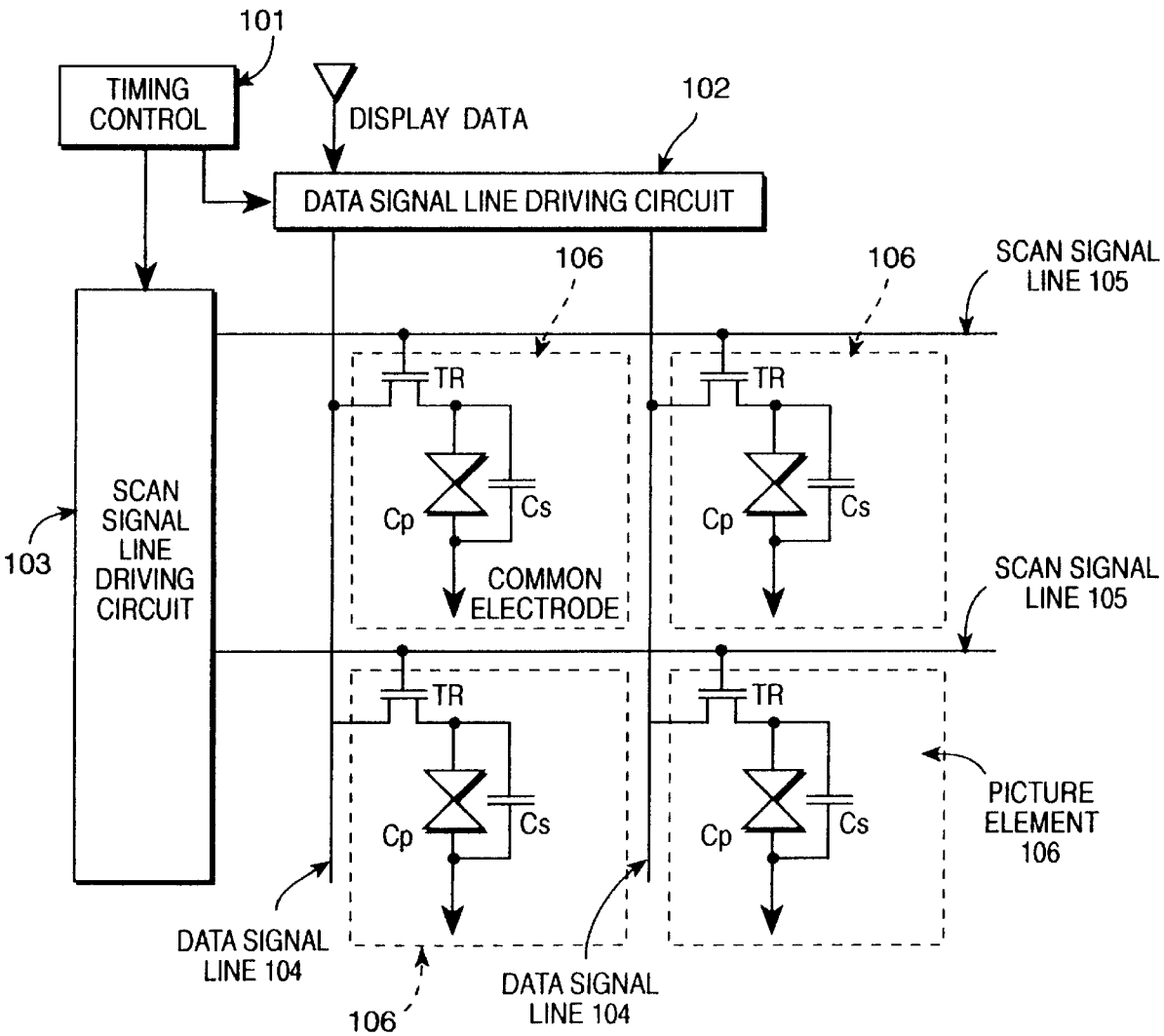
FIG. 25 PRIOR ART
FIG. 25 shows another conventional example and is an explanatory drawing which shows an arrangement of a picture element circuit in a liquid crystal display apparatus.
Figure 27:
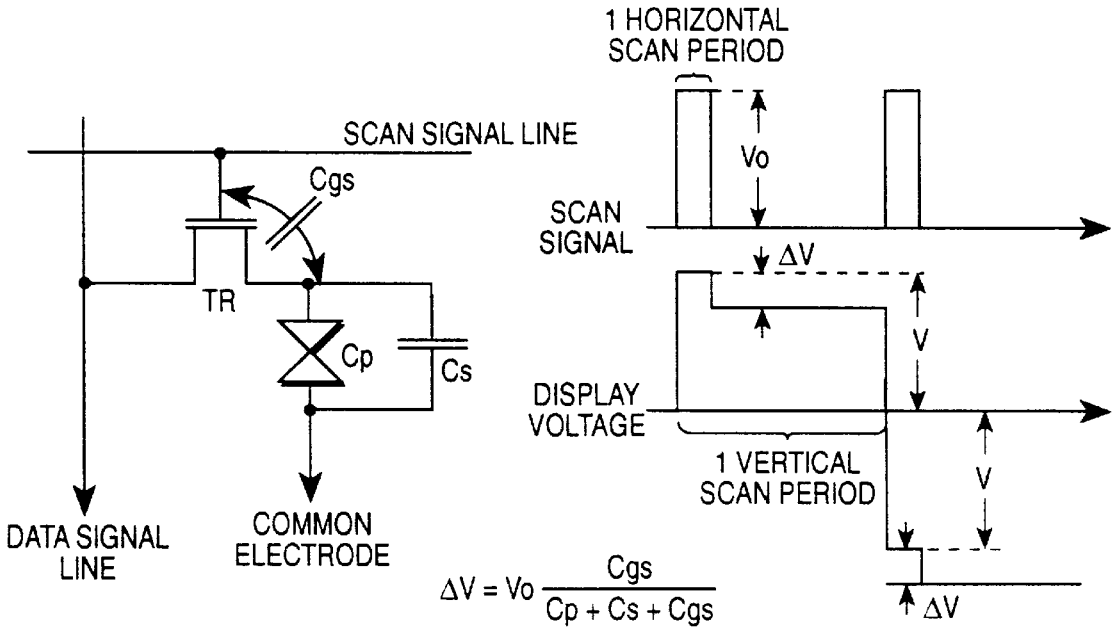
FIG. 27 PRIOR ART
FIG. 27 is an explanatory drawing which shows an operation of a conventional picture element circuit.
Figure 28:
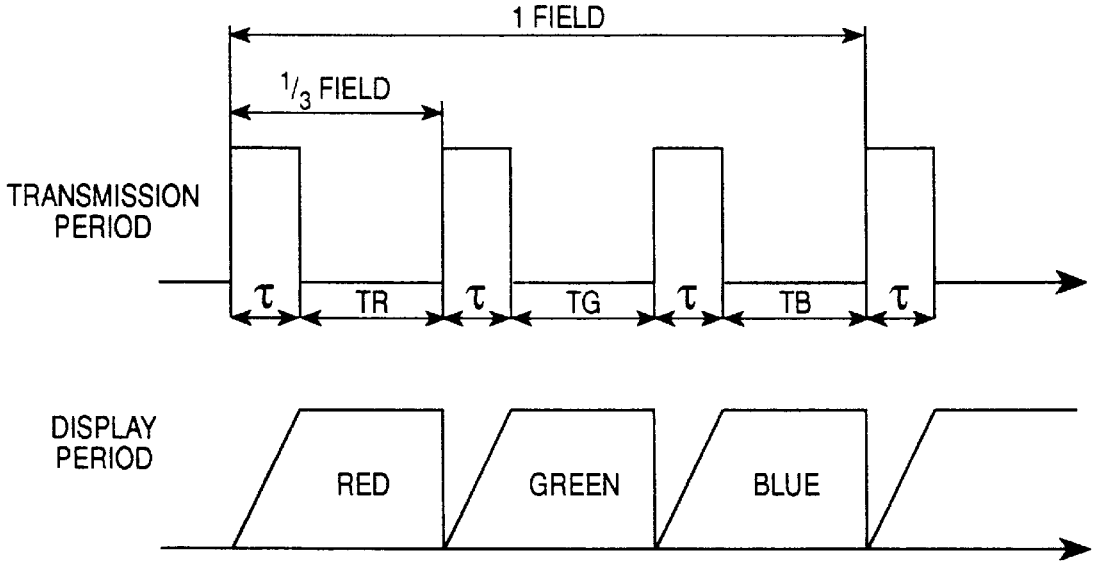
FIG. 28 PRIOR ART
FIG. 28 is a timing chart which explains a conventional field sequential scan system.

As shown in FIG. 25, for example, a picture element circuit is arranged so that an auxiliary capacity Cs obtains a value which provides display data retention of less than 99%, or that the auxiliary capacity Cs is eliminated. An example of a basic arrangement of a driving circuit is shown in FIG. 4 (in the case of x×y matrix). The insides of frame memories 112, 113 are divided into blocks 118 through 123 where red image display data, green image display data, blue image display data for one frame period are respectively stored. Moreover, a timing control section 114 has a function for generating a timing signal which reads out the red, green and blue image display data.

Figure 5:
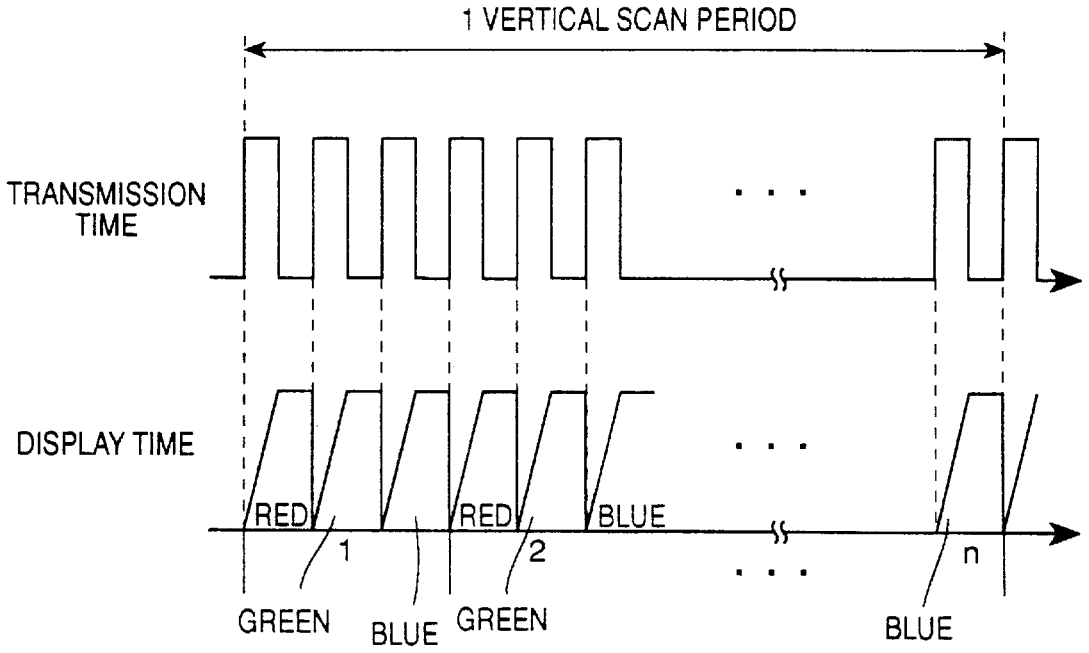
FIG. 5 is a timing chart in the case where the present invention is carried out by the field sequential scan system.

Next, the following will discuss an operation. Field sequential display data are inputted to an A/D converter 111 (in the case where the display data are a field sequential display RGB signal, one A/D converter, and in the case of being a general RGB signal, three A/D converters), and after an analog signal is converted into a digital signal in order to store the field sequential display data to a field memory, the converted signal is stored to a red data storing section 118, a green data storing section 119 and a blue data storing section 120 in the frame memory 112 as red, green and blue image display data for one frame period. At the same time, red, green and blue image display data before one frame are read out from the frame memory 113, in which the display data for one frame have been stored in a red data storing section 121, a green data storing section 122, and a blue data storing section 123, according to a reading out signal generated in the timing control section 114. The above red, green and blue image display data for one frame are serially read out n times during one frame period (16.7 [msec]) in a constant order. In other words, as shown in FIG. 5, three image display data: red, green and blue ones composes one set, n sets of the display data are read out for one frame period (an order of reading out the display data is not cared). Next, after the display data read out from the frame memory 113 is converted from a digital signal to an analog signal in the D/A converter 115, an polarity of the display data is inverted in an inverting circuit 116 by an inverting signal generated in a timing control section 114 (1H line inversion, one field inversion or field+1H line inversion). Thereafter, the display data with inverted polarity are inputted to a data driver 102 and are sampled therein. The sampled display data are outputted to a data signal line so as to be written into each prescribed picture element.

As shown in FIG. 5, the timing of writing at this time operates a scan driver at a timing which synchronizes with n times of reading out of the display data for one frame period from the frame memory 113 (a timing that y number of scan signals can be outputted within 16.67/n [msec]), and a data signal line driving circuit 102 is also operated on a frequency that x numbers (a number of one horizontal line picture element) of display data can be sampled and written within a pulse width of each scan signal.

The above operation makes a cycle of time mixture of colors high speed so an operator does not feel incongruous with one's visual sensitivity. Therefore, heightening of display data retention and reduction in a size of a picture element circuit (reduction in a size of a picture element) make it possible to improve a yield and highly refine the apparatus without a complicated arrangement of a picture element circuit shown in FIGS. 29 and 30, which was proposed in Japanese Unexamined Patent Publication No. 4-310925/1991 (Tokukaihei 4-310925) in order to heighten display data retention, but with an arrangement of one transistor which provide a high aperture ratio.

[Embodiment 3]

Next, the following will discuss a second embodiment of coloring in the same field sequential scan system.

Figure 6:
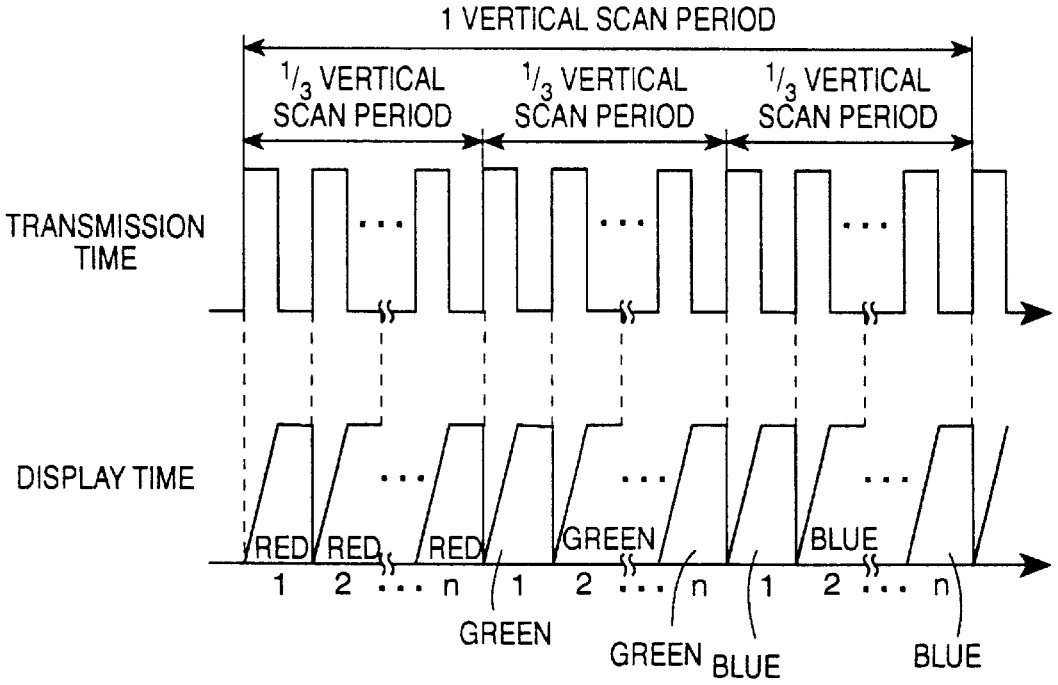
FIG. 6 is another timing chart in the case where the present invention is carried out by the field sequential scan system.

Arrangements of a picture element circuit and a driving circuit are same as those in embodiment 2. As to an operation, one frame period is divided into three as shown in FIG. 6, for example, by changing timing of a read out signal generated in a timing control 114 shown in FIG. 4, and red image display data are read out n times within ⅓ period, green image display data n times within next ⅓ period and blue image display data n times within the last ⅓ period so as to be written to prescribed picture elements (the operation is not limited to this and may be performed in any combination of display data). The above arrangements of the circuits and the driving method make it possible to improve a yield and highly refine the apparatus due to heightening of display data retention and reduction in a size of the picture element circuit (reduction in a size of a picture element).

[Embodiment 4]

Figure 7:
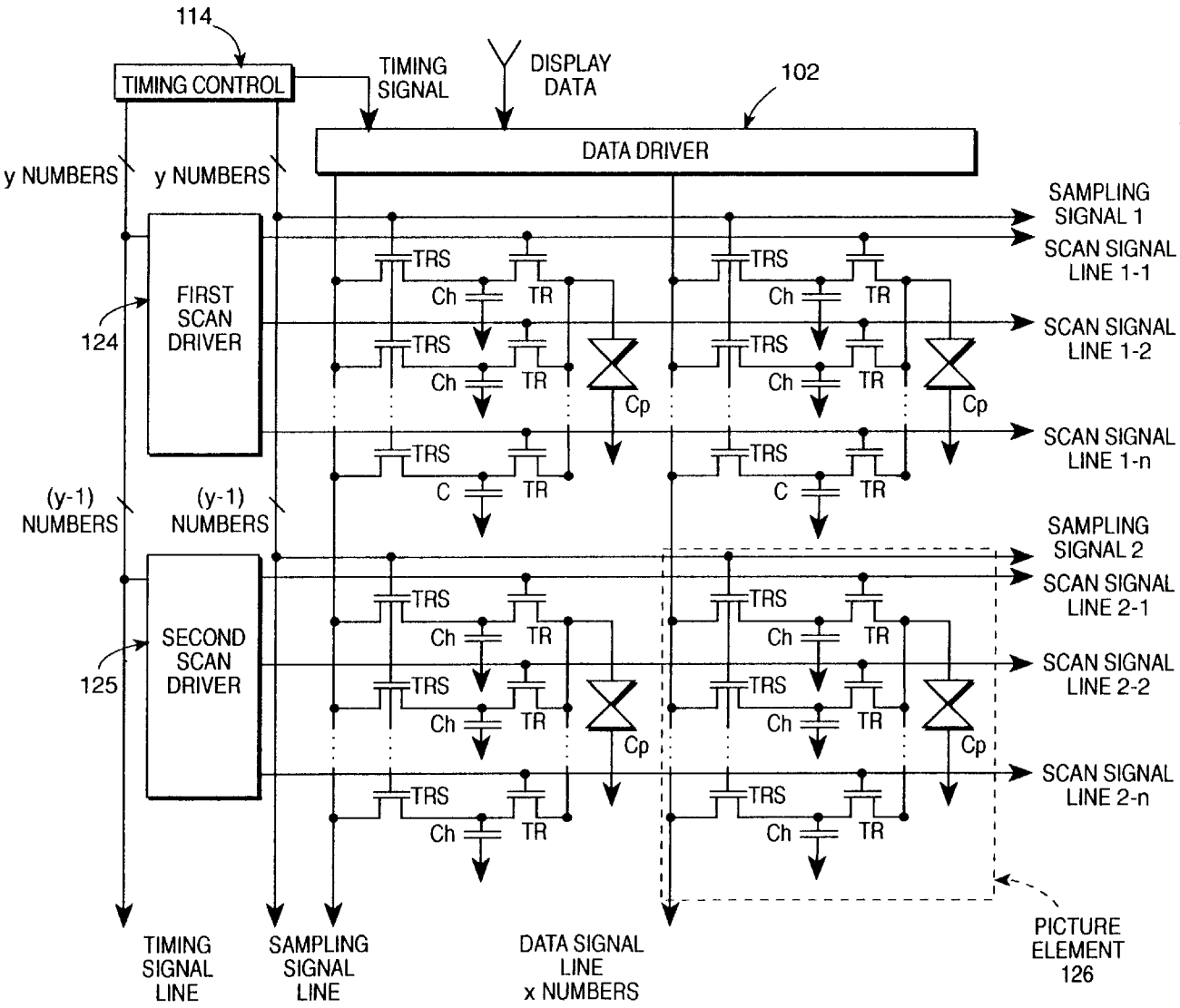
FIG. 7 is a block diagram which explains another embodiment of the present invention.
Figure 8:
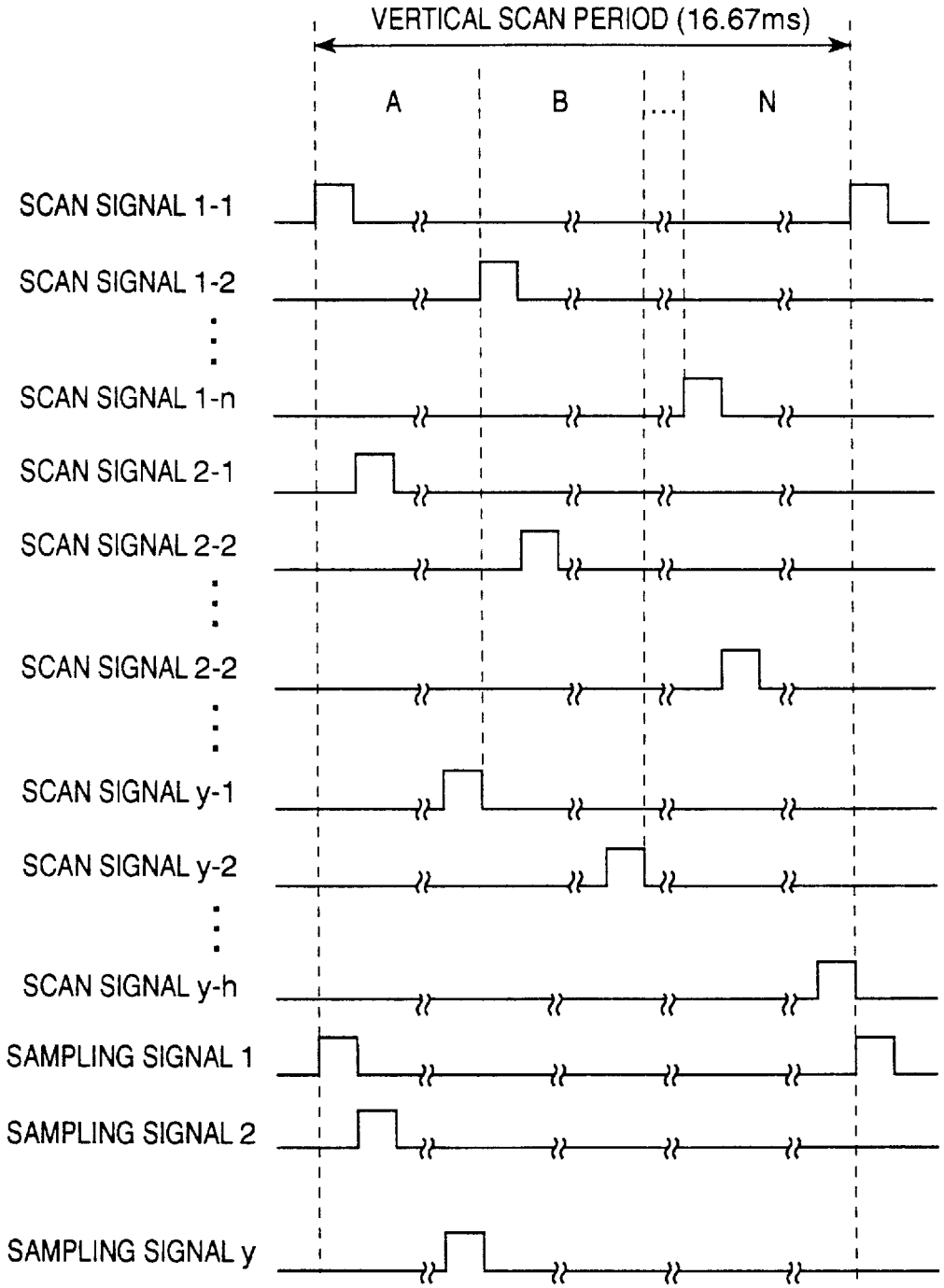
FIG. 8 is a timing chart which explains an operation of FIG. 7.

In addition, display data corresponding to each picture element can be written to prescribed picture elements n times within 1 vertical scan period by performing an operation in an example of a system arrangement shown in FIG. 7 and also in a timing chart shown in FIG. 8 corresponding to the example.

First, an arrangement is explained. In FIG. 7 (in the case of x×y matrix), 114 is a timing control, 124 is a first scan driver, 125 is a second scan driver (a same number of scan drivers as that of horizontal scan exist. In this case, y numbers of scan drivers are required), and n numbers of scan signal lines are connected to each scan driver and x numbers of data signal lines to a data driver 102. A picture element circuit 126 is formed at each intersection of the scan signal lines and the data signal lines in a form shown in FIG. 7. In the picture element circuit, n numbers of sampling elements TRS are connected to intersections of the data signal lines and sampling signal lines, and finally outputs of the sampling elements TRS are connected to one picture element capacity Cp through a pair of sampling capacities Ch and a TR as a switching element.

Referring to a timing chart shown in FIG. 8, the following will discuss an operation. The data driver outputs display data for one horizontal period to the data signal lines within one pulse width of a sampling signal 1 generated in the timing control circuit 114, and successively outputs y numbers of display data to the data signal lines. In FIG. 8 the display data for one field are sampled within a period of A so as to be outputted. Next, the display data on the data signal lines per horizontal line are successively written through the TRS to the sampling capacities Ch by sampling signals 1 through y. Thereafter, the display data are written from the sampling capacities Ch to the picture element capacity n times during one frame period by scanning the scan signal lines in the order of 1—1, 2-1, . . . y-1 (period of A in FIG. 8), 1-2, 2-2, . . . y-2 (period of B in FIG. 8), 1-n, 2-n, . . . y-n (period of N in FIG. 8).

The above operation makes the data driver 102 possible to carry out sampling only once, thereby making it possible to reduce and disuse an auxiliary capacity Cs while reducing the burden of the data signal line driving circuit 102 without lowering the display data retention.

[Embodiment 5]

As to an example of the above picture element circuit configurations, FIG. 25 shows a configuration in which an auxiliary capacity Cs obtains a value which provides the display data retention becomes of less than 99%, or a configuration in which the auxiliary capacity Cs is eliminated. Furthermore, FIGS. 9 and 10 show examples of the picture element circuit configuration for controlling an influence on a switching element by a parasitic capacity Cgs (Cgd).

Figure 9:
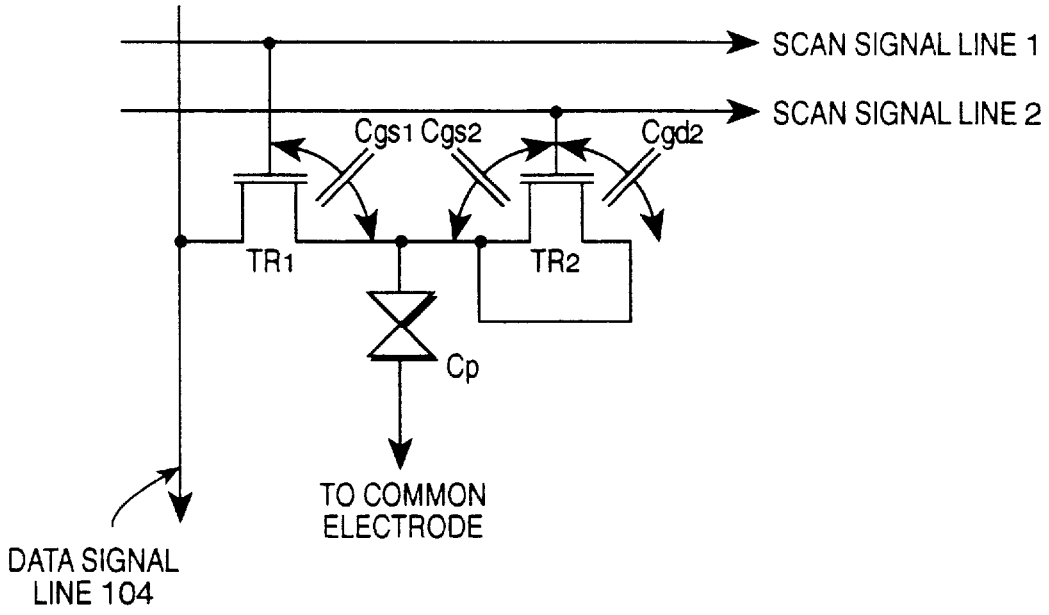
FIG. 9 is an explanatory drawing which shows a constitutional example of a picture element circuit of the present invention.

In FIG. 9, the auxiliary capacity Cs is completely eliminated from the picture element circuit configuration shown in FIG. 25, and TR2 as MOSFET and scan signal line 2 are added thereto. The picture element circuit has a configuration that a drain and a source of the TR2 are connected to a picture element electrode and that a gate is connected to the scan signal line 2. Here, the Cgs1 is a parasitic capacity between the gate and the source of the TRI, Cgs2 is a parasitic capacity between the gate and the source of the TR2, Cgd2 is a parasitic capacity between the gate and drain, and TR2 is a transistor size that the formula: "Cgs2+Cgd2=Cgs1" holds.

A normal scan signal corresponding to each picture element is applied to the scan signal 1, and a waveform having an opposite phase to the above scan signal is applied to the scan signal line 2. As a result, since a direction of a voltage shift in a picture element electrode generated by the Cgs1 and a picture element capacity Cp is different from that of a voltage shift in a picture element electrode generated by the Cgs2 and the Cgd2, the shifts are cancelled, thereby making it possible to control influences due to the shifts.

Figure 10:
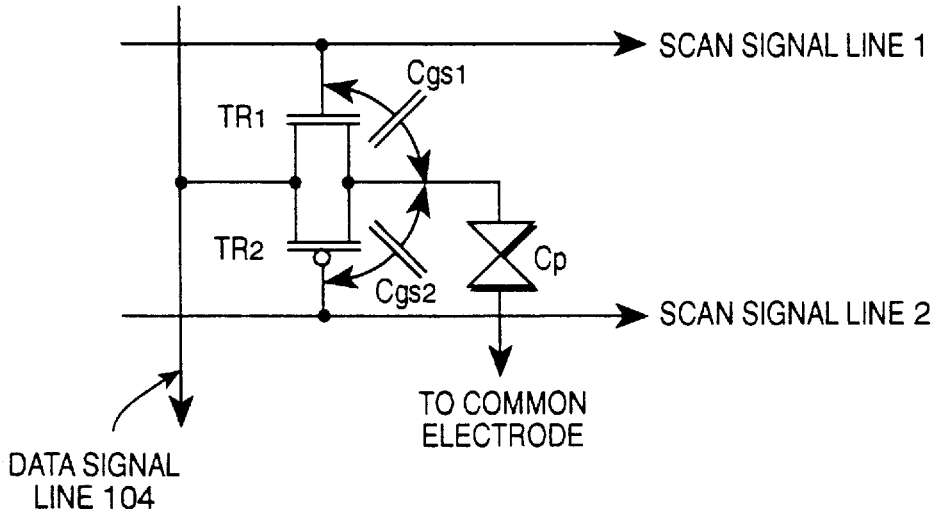
FIG. 10 is an explanatory drawing which shows another constitutional example of the picture element circuit of the present invention.

Also in FIG. 10, the auxiliary capacity Cs is completely eliminated from the picture element circuit configuration shown in FIG. 25, and the TR2 as MOSFET and the scan signal line 2 are added thereto. The TR2 has a complementary-type arrangement that an analog switch is formed together with the TR1, and has a transistor size so that electrostatic capacities of the Cgs1, which is the parasitic capacity between the gate and the source of the TR1, and of the Cgs2, which is the parasitic capacity between the gate and the source of the TR2 becomes equal.

A normal scan signal corresponding to each picture element is applied to the scan signal line 1, and a waveform having an opposite phase to the above scan signal is applied to the scan signal line 2, thereby making it possible to obtain similar results to those of the picture element circuit shown in FIG. 9.

Figure 29:
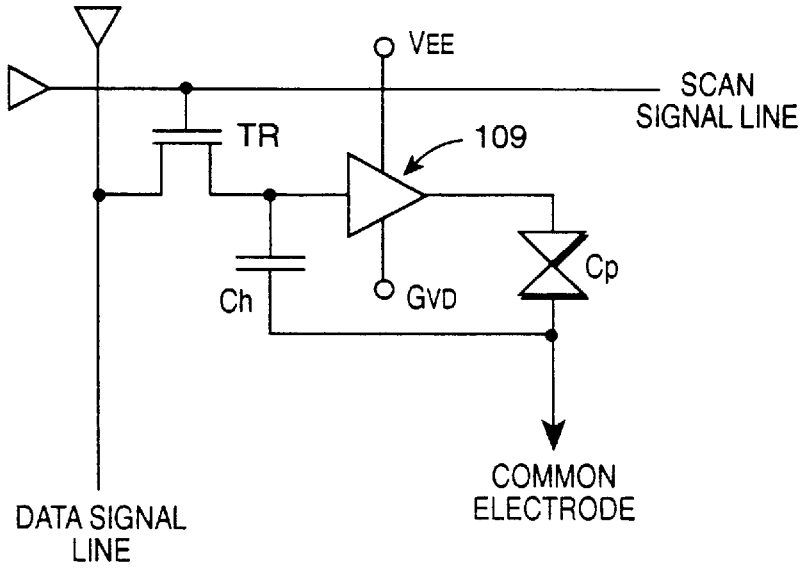
FIG. 29 PRIOR ART
FIG. 29 is an explanatory drawing which shows an example of an arrangement of another conventional picture element circuit.
Figure 30:
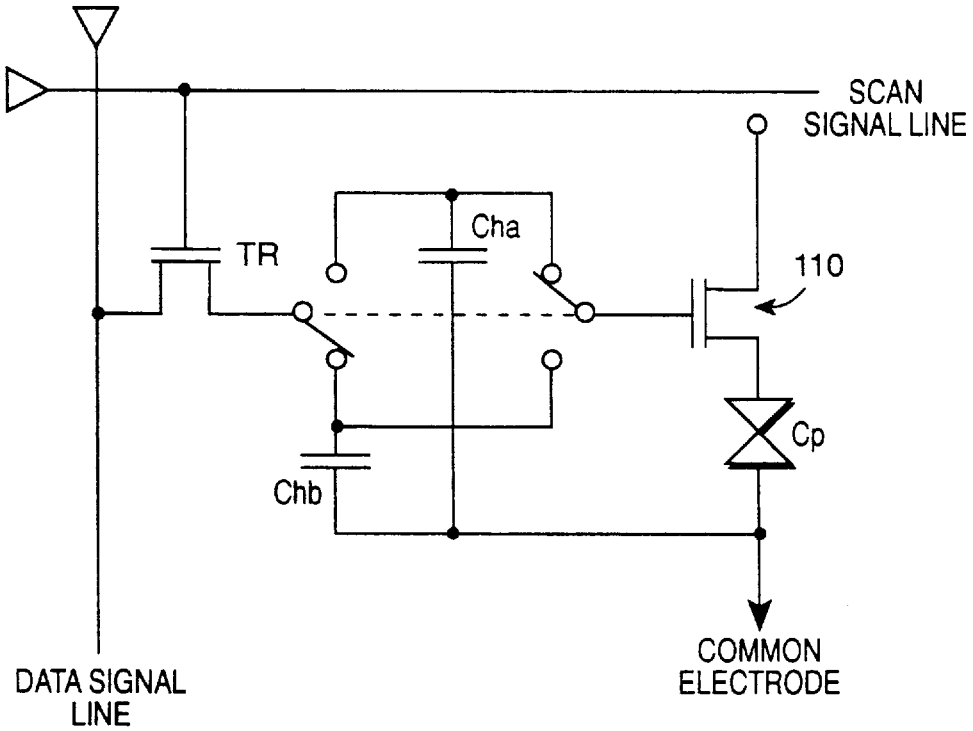
FIG. 30 PRIOR ART
FIG. 30 is an explanatory drawing which shows an arrangement of still another conventional picture element circuit.
Figure 31:
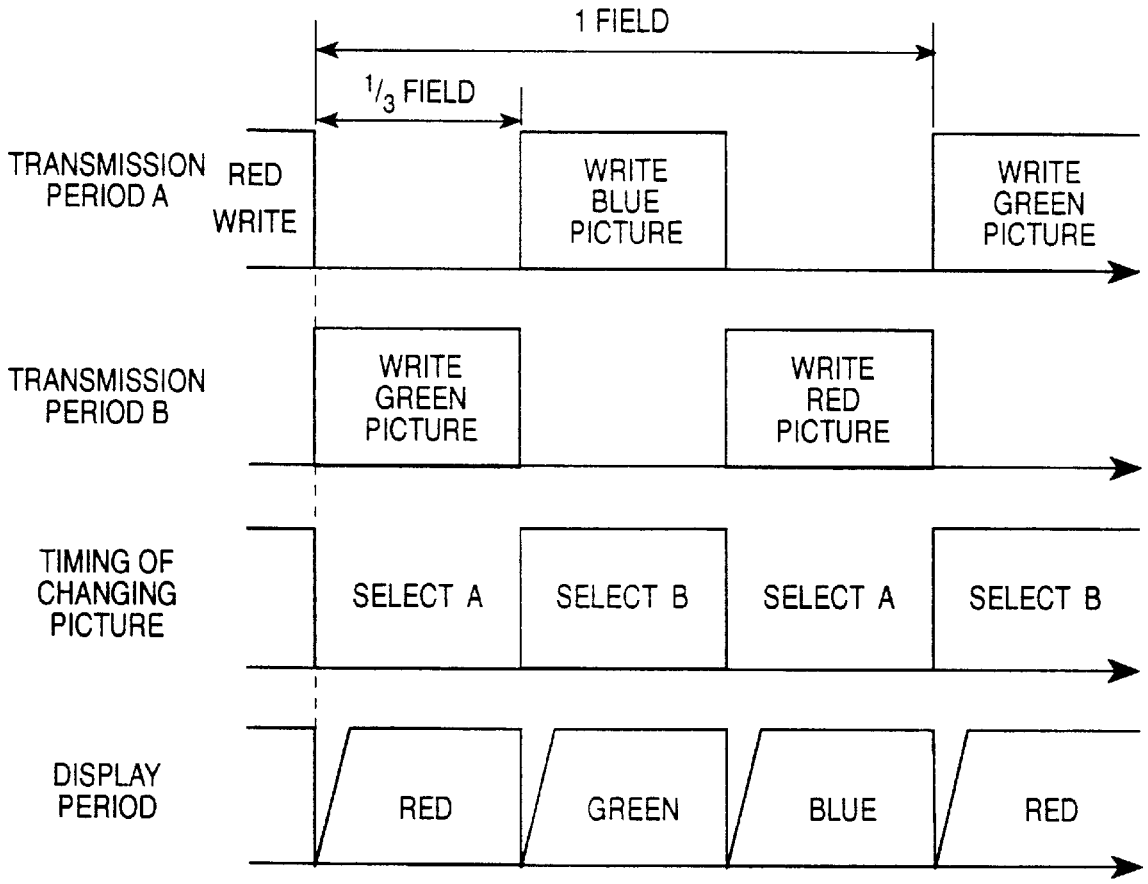
FIG. 31 PRIOR ART
FIG. 31 is a timing chart which explains another example of a conventional field sequential scan system.
Figure 32:
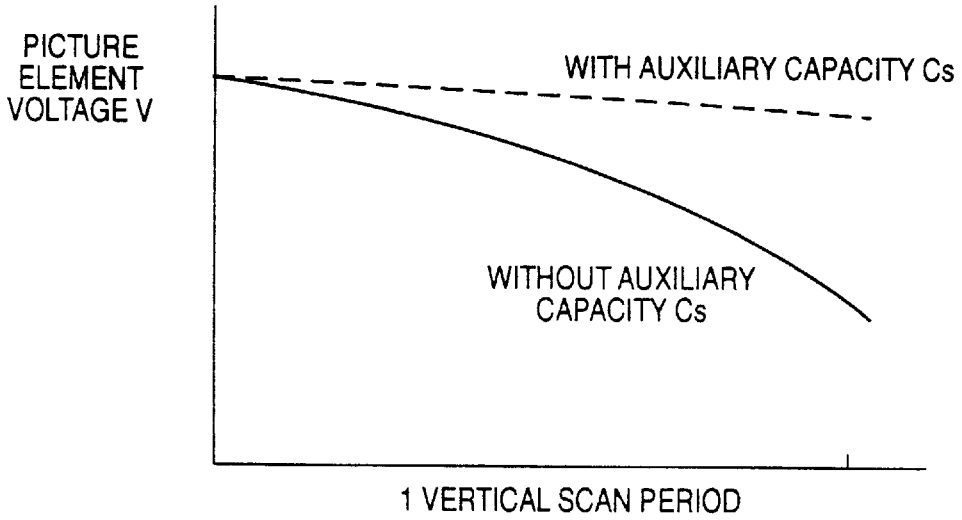
FIG. 32 PRIOR ART
FIG. 32 is an explanatory drawing of display data retention in the cases where an auxiliary capacity Cs exists and does not exist.

Conventionally, the auxiliary capacity Cs was connected to the common electrode or the scan signal line of a preceding stage, but since the present invention can be disused the above connection, the arrangement becomes simple, thereby improving an aperture ratio. Furthermore, even if the auxiliary capacity Cs cannot be disused, the aperture ratio can be improved by reducing a value of the auxiliary capacity Cs. Moreover, display data retention can be also improved. In the case where a field sequential scan system is executed, since a complicated circuit configuration shown in FIGS. 29 and 30 is not required, a size of a picture element circuit is reduced (reduction in a size of a picture element), thereby making it possible to improve yield and refine the apparatus.

Further, not only in the case where the auxiliary capacity Cs is reduced, but also in the case where an OFF current of a sampling circuit, a hold circuit, etc. in a data driver and of a transistor which forms all kinds of circuits in a picture element section, or in the case where parallel resistance component of a sampling condenser, a data hold condenser and another condenser is small, a fluctuation in data occurs, but it can be restrained.

Further, in the case where a TFT is used as a switching element, a voltage shift of a picture element electrode, which occurs due to division of a capacity into parasitic capacities Cgd and Cgs and a picture element capacity between a gate and a source or a drain of the TFT, is offset so that flicker, etc. arising from this can be restrained.

As mentioned above, in the case where a memory is provided outside a picture element and a substrate on which a memory is formed and a substrate on which a picture element array is formed are separately provided, it is considered that there exists a lot of advantages, whereas the connection is comparatively troublesome and an advantage of the driver monolithic technique which improves package efficiency of an image display apparatus is deteriorated. Therefore, the following will discuss an example which resolves the above problem.

[Embodiment 6]

Referring to FIGS. 11 through 17, the following will discuss one embodiment of the present invention.

Figure 11:
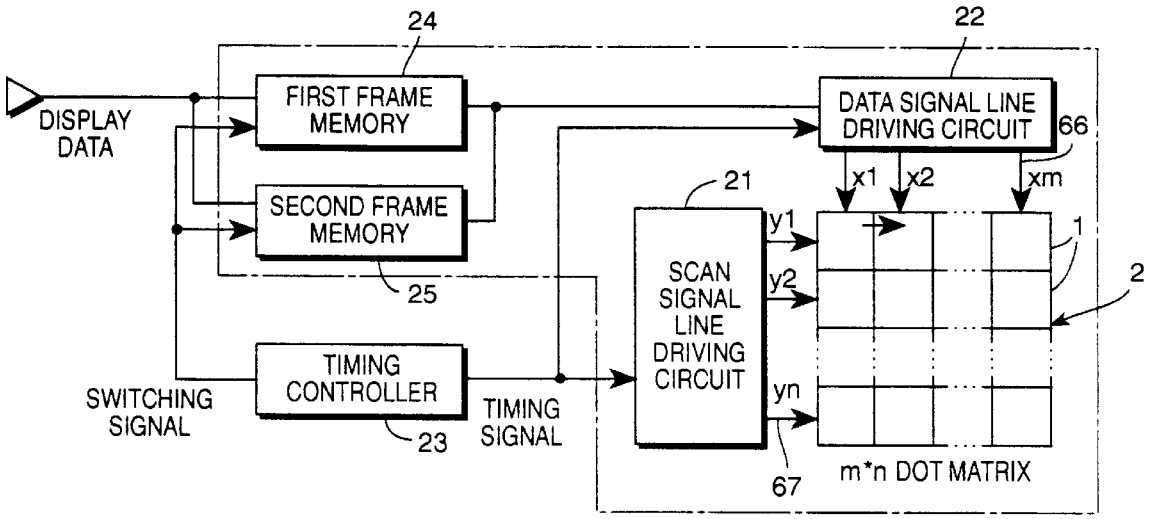
FIG. 11 is a block diagram which shows an arrangement of a liquid crystal display apparatus in one embodiment of the present invention.

Further, a liquid crystal display apparatus, for example, as an image display apparatus of the present invention is applied to an active matrix-type liquid crystal display apparatus; and, as shown in FIG. 11, it has a picture element, array 2 in which a plurality of picture elements 1 are arranged in a matrix fashion of m×2.

Figure 12:
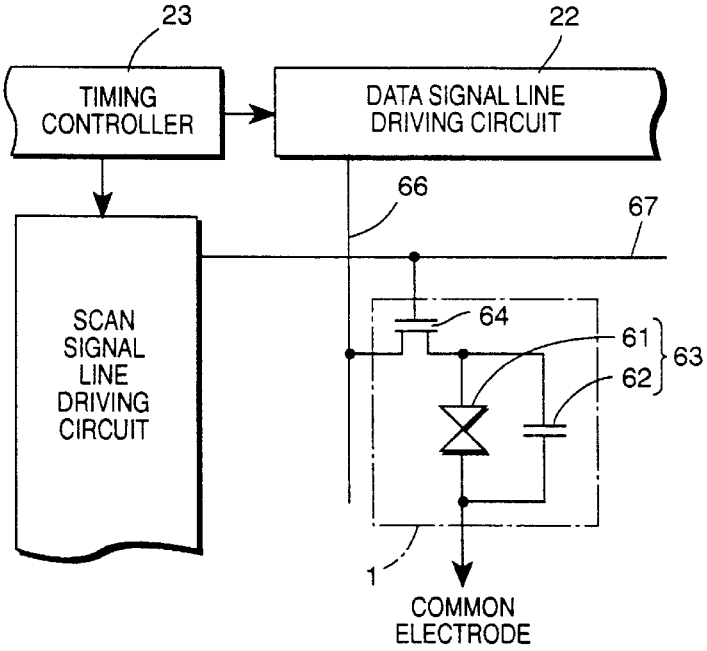
FIG. 12 is a structural drawing which shows a picture element in the liquid crystal display apparatus.

As shown in FIG. 12, the picture element 1 is composed of a picture element capacity 63, which is composed of a liquid crystal capacity 61 and an auxiliary capacity 62, and a MOS (Metal Oxide Semiconductor) transistor 64, which is composed of polycrystal silicon.

In addition, the picture element 1 is formed on a light transmitting-type insulating substrate 5 such as a glass substrate, mentioned later. A data signal line 66 and a scan signal line 67 for driving the picture element 1 which are connected to the MOS transistor 64 are formed on the insulating substrate 5. Respective picture elements 1 are arranged in a position which is surrounded by the adjoining data signal lines 66 and the adjoining scan signal lines 67.

As shown in FIG. 11, the data signal lines 66 and the scan signal lines 67 are respectively connected to a scan signal line driving circuit 21 and a data signal line driving circuit 22 as driving circuits, which are formed beside the picture element array 2 on the insulating substrate 5 as one unit, and a first frame memory 24 and a second frame memory 25, mentioned later, are also formed on the insulating substrate 5. Therefore, in FIG. 11, the MOS transistor 64 . . . , the scan signal line driving circuit 21, the data signal line driving circuit 22, the first frame memory 24 and the second frame memory 25 in each picture element 1, which is indicated by alternate long and short dashes lines in FIG. 11, are formed as one insulating substrate 5, and as a result, a driver monolithic technique for improving package efficiency of a circuit element is applied. The following will discuss the arrangements step by step.

The scan signal line driving circuit 21 and the data signal line driving circuit 22 are connected to a timing controller 23 as repetition writing means. Moreover, the data signal line driving circuit 22 is connected to display data through the first frame memory 24 or the second frame memory 25 as memory means, whereas a switching signal is inputted from the timing controller 23 as switching means to the first frame memory 24 and the second frame memory 25.

The timing controller 23 generates a voltage of data to be displayed on each picture element 1 . . . , horizontal and vertical synchronizing signals, etc., for making positioning at the time of displaying data, and display data for one horizontal period are sampled in the data signal line driving circuit 22 based upon the signals. Next, the timing controller 23 outputs the sampled signals to the data signal line 66 by a transmission signal generated in the timing controller 23.

The first frame memory 24 and the second frame memory 25 alternately write and read out data per one frame, namely, in the case where a frame frequency is 60 Hz, per 16.67 msec. Here, one frame is one completed image to be displayed on the whole picture element array 2.

In addition, in the present embodiment, the first frame memory 24 as the memory means and as one of segment memory means and the second frame memory 25 as the memory means and as the other segment memory means are segmented into a total of two memories, but they are not limited to this, so they may be segmented into not less than two memories.

Figure 13:
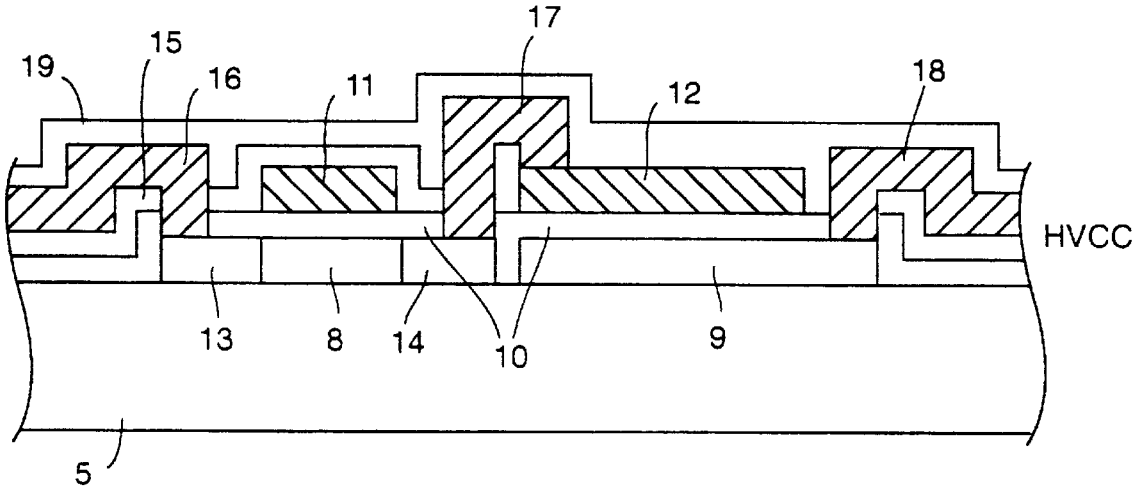
FIG. 13 is a structural drawing which shows a first frame memory and a second frame memory in the liquid crystal display apparatus.

Incidentally, in the present embodiment, a memory cell which composes the first frame memory 24 and the second frame memory 25 is arranged so as to have a switching element and a capacitor which are same as those of the DRAM as shown in FIG. 13. Here, memory capacity in the first frame memory 24 or the second frame memory 25 is arranged so that the following relationship holds:

Memory capacity ≧A number of picture element×A number of colors×A number of gradations.

Here, a number of colors becomes 3 in color and becomes 1 in monochrome. Moreover, a number of gradations becomes 8 in gradation of 256, 6 in gradation of 64, and 3 in gradation of 8.

In the case where the first frame memory 24 and the second frame memory 25 are formed, a semiconductor layer 8 composed of polycrystal silicon and a first capacity electrode 9 composed of a polycrystal silicon semiconductor, and a gate insulating film 11 is formed thereon. Next, a gate electrode 11 is formed on the gate insulating film 10 on the semiconductor layer 8, and a second capacity electrode 12 is formed on the gate insulating film 10 on the first capacity electrode 9.

Successively, a source electrode 13 and a drain electrode 14 are formed on the semiconductor layer 8. Furthermore, after a layer insulating film 15 is formed, metallic wiring 16 which is a bit line, a metallic wiring layer 17 for connecting the drain electrode 14 and the second capacity electrode 12, and data signal line metallic wiring 18 for connecting an HVCC terminal as an intermediate potential and the first capacity electrode 9 are formed. Finally, a protective film 19 is formed.

Figure 14:
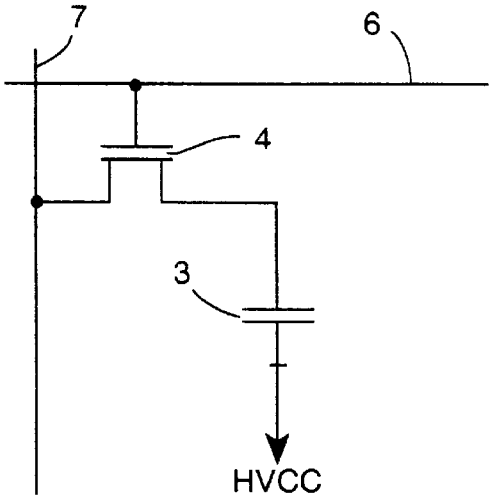
FIG. 14 is an equivalent circuit diagram of the first frame memory and the second frame memory.

The above arrangement is equivalent to a circuit shown in FIG. 14. The MOS transistor 4 for a memory which is a switching element composed of the semiconductor layer 8, etc. and a data holding capacity 3 composed of the first capacity electrode 9 and the second capacity electrode 12, are integrated as one unit so as to form one memory cell. The memory cell has the same arrangement as that of a DRAM (Dynamic Random Access Memory).

The metallic wiring 16 in the MOS transistor 4 for a memory is connected to a bit line 7, and the gate electrode 11 is connected to a word line 6. Moreover, the drain electrode 14 of the MOS transistor 4 for a memory is connected to the first frame memory 24 or the second frame memory 25 as the data holding capacity 3.

Thereafter, the MOS transistor 4 for a memory is turned ON by applying a prescribed voltage to the word line 6, and display data to be supplied to a bit line 7 is stored to the data holding capacity 3. Similarly, the MOS transistor 4 for a memory is turned ON by applying a prescribed voltage to the word line 6 and the display data stored in the data holding capacity 3 are read out through the bit line 7. Therefore, the liquid crystal display apparatus performs the same operation as that of the DRAM. Furthermore, a normal DRAM requires a refresh circuit on the outside, but in the driving method of the present embodiment, as mentioned later, the first frame memory 24 and the second frame memory 25 read out and rewrite the display data per 1/z in one frame period in the case where a frame frequency is 60 Hz, 16.67×I/Z [msec]. This makes it possible that the refresh circuit is not required.

Further, in the present embodiment, a glass substrate with a low price and a low melting point is used as the insulating substrate 5. The MOS transistor 64, the first frame memory 24, the second frame memory 25 of the scan signal line driving circuit 21 and the data signal line driving circuit 22 in the picture element 1 are formed at a process temperature of not more than 600° C.

The following will discuss an operation of the liquid crystal display apparatus having the above arrangement.

Figure 15:
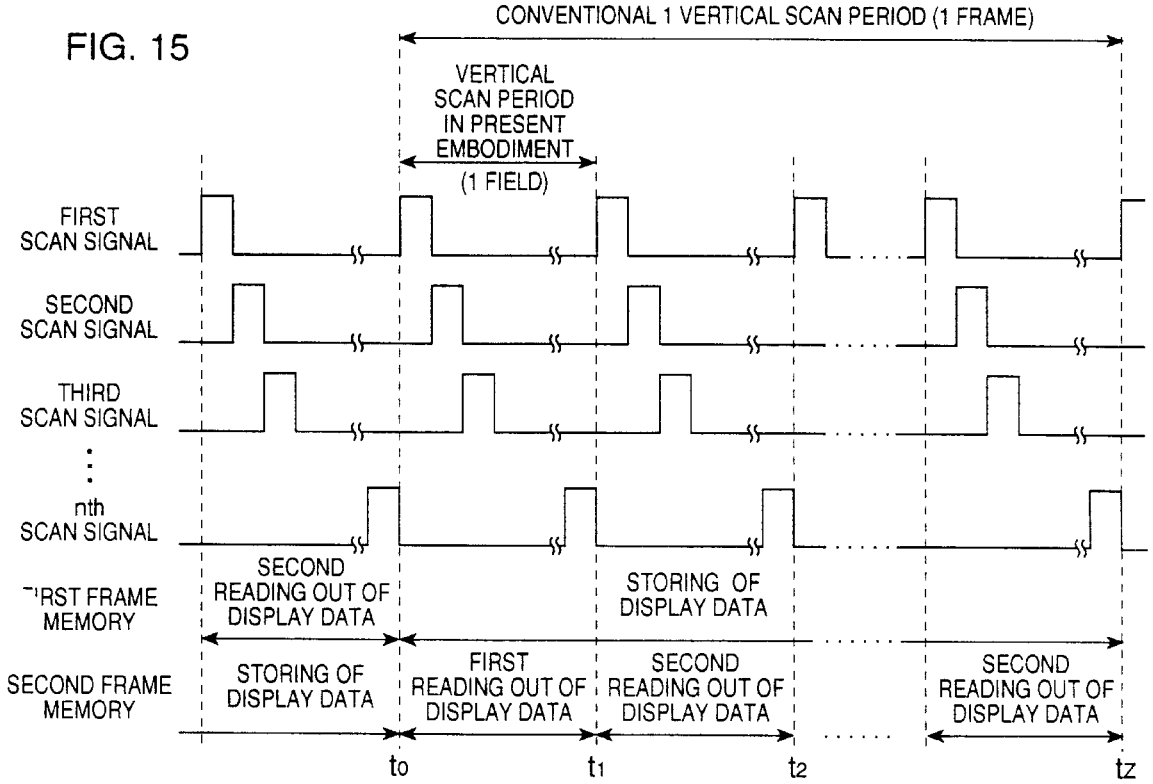
FIG. 15 is a timing chart which shows a driving operation of the liquid crystal display apparatus.

As shown in FIG. 15, in a first state to, according to a switching signal generated in the timing controller 23, the first frame memory 24 will write data and the second frame memory 25 will read out data. However, the display data one frame before have been stored in the second frame memory 25.

In this state, the first frame memory 24 writes and stores display data of a current frame within one frame period.

At the same time, the second frame memory 25 repeats reading out of the stored display data one frame z times during one frame period (z is an integral number of not less than 2). As shown in FIG. 11, the read out display data one frame before are inputted to the data signal line driving circuit 22, sampled by a timing signal from the timing controller 23 and outputted to the data signal line 66.

At the same time, a scan signal is outputted from the scan signal line driving circuit 21 by the timing signal from the timing controller 23 so that display data are written to a prescribed picture element 1.

In other words, the timing controller 23 operates the scan signal line driving circuit 21 in timing, which makes it possible to output n numbers of scan signals within one frame period (in the case where the frame frequency is 60 Hz, 16.67/z [msec]), according to a reading out speed of the second frame memory 25, whereas the timing controller 23 also operates the data signal line driving circuit 22 on a frequency, which makes it possible to sample and write m numbers of display data within a pulse of the scan signals. As a result, operation frequencies of the data signal line driving circuit 22 and the scan signal line driving circuit 21 become z times an operation frequency in the case where display data are written to each picture element 1 . . . once during one frame period.

In this way, in the liquid crystal display apparatus of the present embodiment, the MOS transistor 64 for driving the picture element 1, the scan signal line driving circuit 21 and the data signal line driving circuit 22 for transmitting a driving signal, and the first frame memory 24 and the second frame memory 25 for storing display data for one frame are formed on one insulating substrate 5. This makes it possible to improve package efficiency and to lower costs.

In addition, only a step of producing the data holding capacity 3 is added to the existing process or the first frame memory 24 and the second frame memory 25, which can be monolithically formed by the same process as that of the auxiliary capacity 62, are used thereby making it possible to further improve package efficiency and lower costs.

In addition, in the liquid crystal display apparatus of the present embodiment, new display data for one frame are stored in at least either of the first frame memory 24 or the second frame memory 25 by the timing controller 23. For example, while display data are being stored in the first frame memory 24, the display data for one frame stored in the second frame memory 25 are read out to the scan signal line driving circuit 21 and the data signal line driving circuit 22 by the timing controller 23. The timing controller 23 alternately stores in and reads out display data to at least either of the first frame memory 24 and the second frame memory 25. As a result, the display data can be simultaneously stored in and read out to the respective driving circuits 21, 22.

Meanwhile, in the case where the display data for one frame stored in the second frame memory 25 are read out to the scan signal line driving circuit 21 and the data signal line driving circuit 22, while new display data for one frame are being stored in the first frame memory 24, the timing controller 23 reads out the display data for one frame stored in the second frame memory 25 to the scan signal line driving circuit 21 and the data signal driving circuit 22 z times (not less than twice) so as to write the same display data to the same picture element 1 n times (not less than twice) during one frame period.

Figure 16:
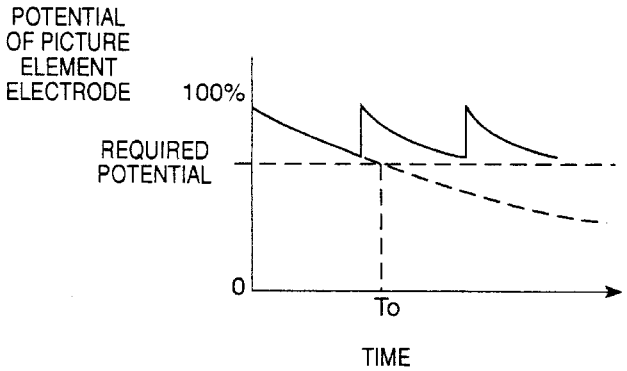
FIG. 16 is a graph which shows a change in decaying of a voltage of a picture element electrode in the liquid crystal display apparatus.

As a result, while new display data for one frame are being stored since the same display data are repeatedly written to the same picture element, a data hold time required for the picture element 1 is shortened, thereby improving retention. In other words, as shown in FIG. 16, a potential of the picture element capacity 63 is attenuated as time passes, but a required potential for display can be always held by heightening the potential of the picture element capacity 63 within time $T_0$ that the potential is attenuated to a required level. Therefore, also in the case where polycrystal silicon TFT is used as a switching element, it is possible to make up for a deficiency in OFF characteristic of the polycrystal silicon TFT and to secure good quality of a picture. In addition, the auxiliary capacity 62 of each picture element 1 can be eliminated or its capacity value can be reduced. For this reason, an aperture ratio of the picture element can be improved, so it is possible to reduce a size of the picture element circuit. As a result, improvement in a rate of acceptable products and refining of the apparatus are possible.

In addition, in the liquid crystal display apparatus of the present embodiment, the constitution of the first frame memory 24 and the second frame memory are the same as that of a DRAM, so the existing technique of DRAM can be utilized.

Further, the construction of a DRAM makes it possible to reduce areas occupied by the first frame memory 24 and the second frame memory.

Meanwhile, in the case where an amorphous silicon TFT in which a semiconductor layer is composed of an amorphous silicon thin film generally used as a switching element is used, driving capacity becomes insufficient so it is difficult to realize a driver monolithic technique.

However, in the present embodiment, the MOS transistor 64, since a polycrystal silicon thin film is used as the semiconductor layer 8, carrier mobility can be obtained much greater than in, and as a result, the driving capacity is high. Each element which composes the first frame memory 24, the second frame memory 25, the scan signal line driving circuit 21 and the data signal line driving circuit 22 can be also monolithically formed by using a polycrystal silicon thin film.

Deficiency in OFF characteristic of the MOS transistor 64 in which the polycrystal silicon thin film is used can be made up by especially writing display data from the first frame memory 24 and the second frame memory 25 to each picture element 1 a plurality of times.

In addition, since an element, which composes the MOS transistor 64, the data signal line driving circuit 22, the scan signal line driving circuit 21, the first frame memory 24 and the second frame memory 25 formed on the insulating substrate 5, is formed at a process temperature of not more than 600° C., a glass substrate with a low price and a low melting point can be used, thereby making it possible to enlarge the apparatus and lower its cost.

Here, the present invention is not limited to the above embodiment so it can be variously changed within the scope of the present invention. For example, in the above embodiment, the data signal line driving circuit 22 is used for inputting a digital signal, but it is not limited to this; for example, it can be used for inputting an analog signal.

Figure 17:
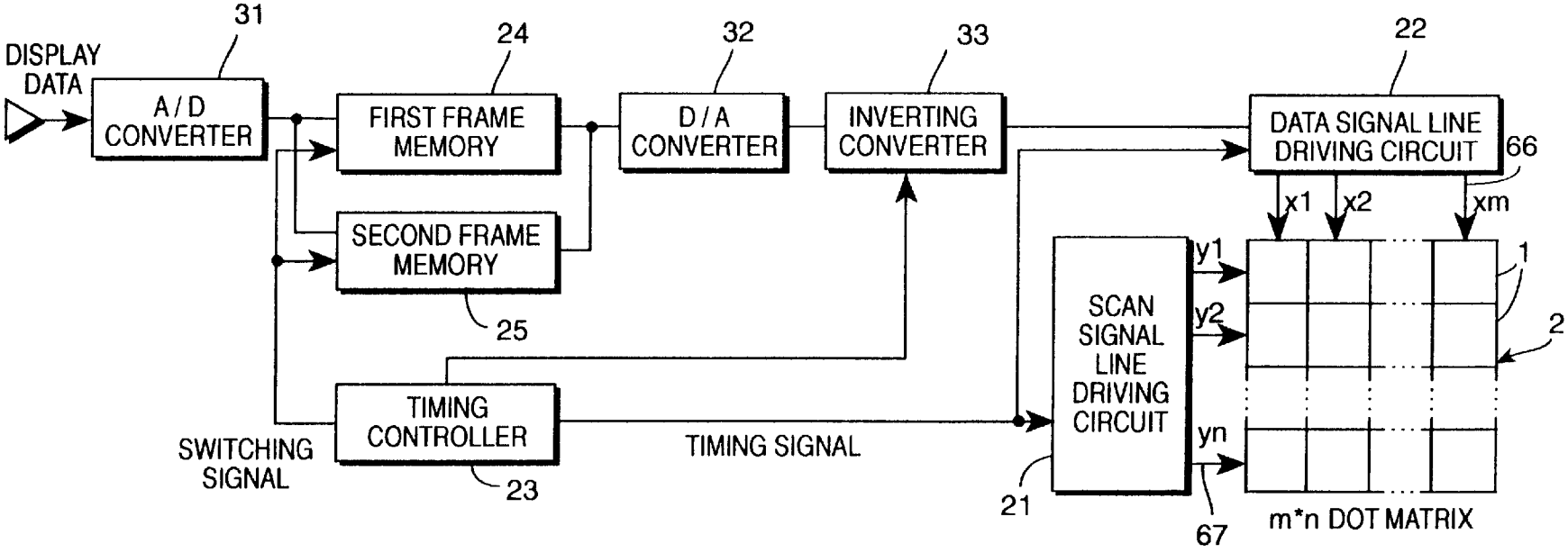
FIG. 17 is a block diagram which shows an arrangement of a changing example in the liquid crystal display apparatus.
Figure 18A:
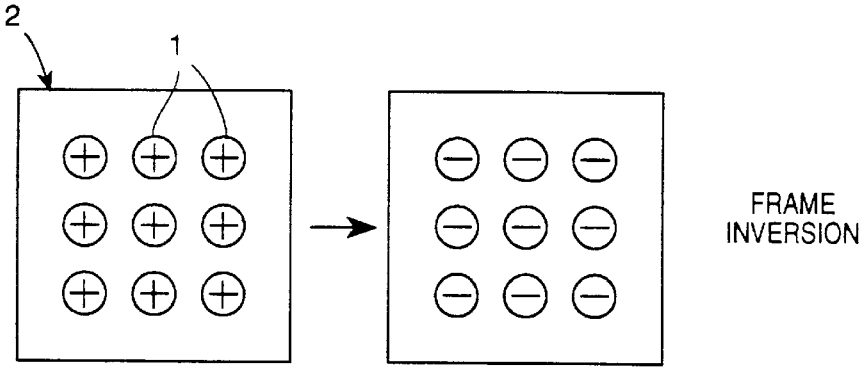
FIGS. 18(*a*) through 18(*d*) are explanatory drawings which show an operation of an inverting circuit in the liquid crystal display apparatus.
Figure 18B:
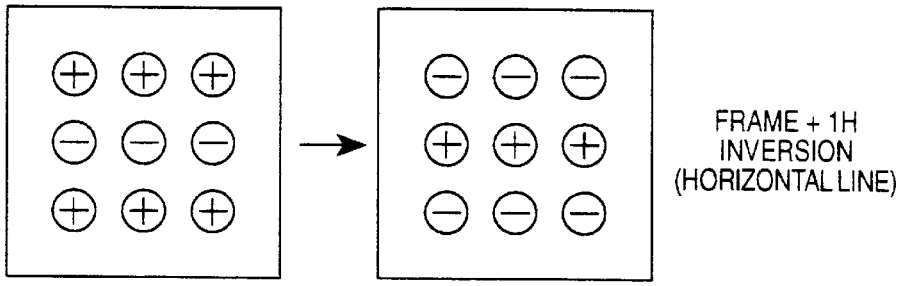
Figure 18C:
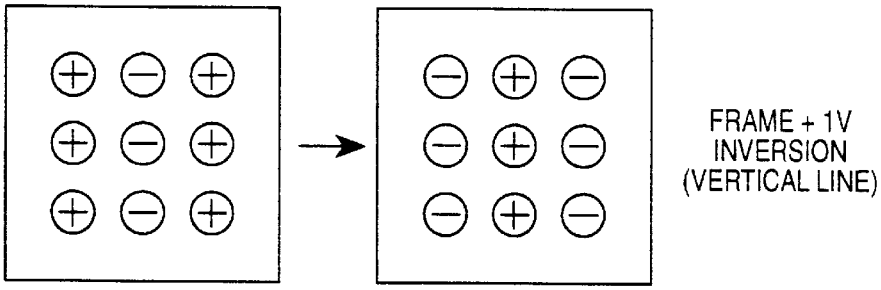
Figure 18D:
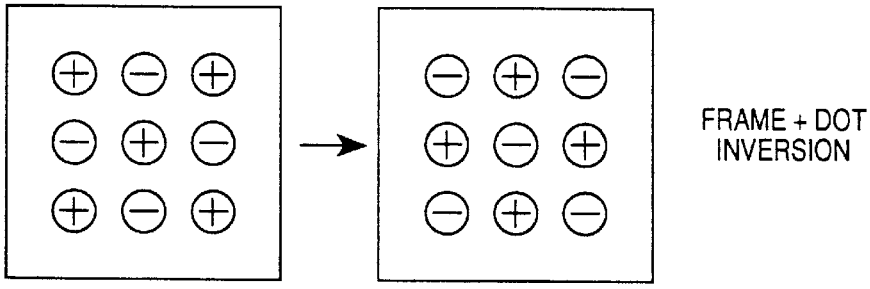

In other words, in the case where the data signal line driving circuit 22 is used for inputting an analog signal, as shown in FIG. 17, the A/D converter 31 for converting analog display data into a digital signal is provided before input to the first frame memory 24 and the second frame memory 25, and the D/A converter 32 and the inverting circuit 33 are connected between the first frame memory 24 and the second frame memory 25 and the data signal line driving circuit 22 in series. The D/A converter 32 converts a digital signal into original analog signal data. Moreover, as shown in FIGS. 18(*a*) through 18(*d*), as the inverting circuit 33 applies an electric field to liquid crystal of each picture element 1 in the picture element array 2 in a same direction, service life of the liquid crystal becomes shorter. Therefore, frame inversion, frame+1 horizontal line inversion, frame+1 vertical line inversion or frame+dot inversion, etc. is carried out for one frame. This inverting drive is required also in the case of inputting a digital signal. As a result, as to the analog display data, an image can be displayed.

In addition, the first frame memory 24 and the second frame memory 25 are not limited to the above arrangement, so they can adopt any active element, and a MIM (metallic Insulator Metal) element, etc. can be also adopted, for example. Moreover, it is desirable that the first capacity electrode 9 and the second capacity electrode 12 are arranged such that a conductive material in the existing process is used, but another material can be used as long as desired capacity is obtained.

[Embodiment 7]

Figure 19:
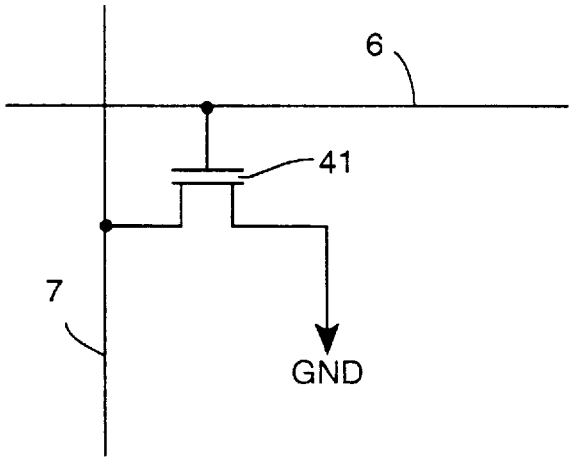
FIG. 19 is an equivalent circuit diagram which shows a structure of a first frame memory and a second frame memory of a liquid crystal display apparatus in another embodiment of the present invention.
Figure 20:
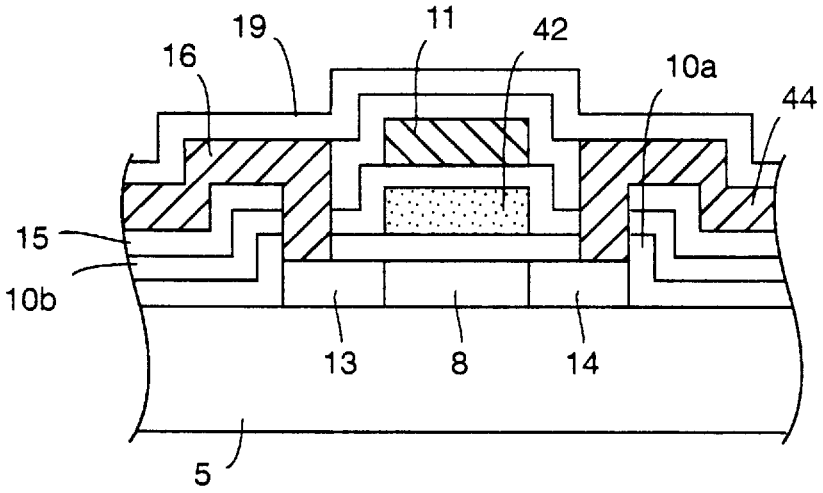
FIG. 20 is a structural drawing which shows the first frame memory and the second frame memory of the above liquid crystal display apparatus.

The following will discuss another embodiment of the present invention referring to FIGS. 19 and 20. Here, for convenience of explanation, those members that have the same arrangement and functions, and that are described in the aforementioned embodiments are indicated by the same reference numerals and the description thereof is omitted.

As shown in FIG. 19, in a frame memory in a liquid crystal display apparatus of the present embodiment, each memory cell, which composes a first frame memory 24 and a second frame memory 25, is composed of a memory transistor 41 of polycrystal silicon.

In the case where the first frame memory 24 and the second frame memory 25, which are composed of the memory transistor 41 of polycrystal silicon, are formed, as shown in FIG. 20, a semiconductor layer 8 composed of polycrystal silicon is formed on an insulating substrate 5 and a first gate insulating film 10*a* and a floating gate 42 are laminated thereon. n-type impurities are injected to the semiconductor layer 8. Next, a source electrode 13 and a drain electrode 14 are formed on the semiconductor layer 8. Next, a second gate insulating film 10*b* is laminated and a gate electrode 11 is formed thereon. Next, after a layer insulating film 15 is formed, a metallic wiring 16 which is a bit line 7 and a metallic wiring 44 for grounding to the drain electrode 14 are formed. Here, the gate electrode 11 is grounded to a word line 6. This arrangement is the same as that of an EEPROM.

The following will discuss a principle of an operation of the above memory cell.

In an initial state, no charge exists at the floating gate 42. First, when a voltage which is even slightly higher than a threshold voltage of the transistor is applied to the gate electrode 11, a current is supplied between the source electrode 13 and the drain electrode 14. Next, when a plus voltage is applied to the gate electrode 11 in the case where an electron is injected into the floating gate 42 by hot electron injection, the plus voltage is offset by a charge of the floating gate 42. However, a charge is induced in a channel by further applying a high plus voltage, and a current flows between the source electrode 13 and the drain electrode 14. In this way, in the case where a charge is injected into the floating gate 42, it is necessary to apply a voltage, which is higher than a source voltage to a certain extent, to the gate electrode 11 so as to turn ON the transistor, namely, it is possible that a current does not flow at the normal gate voltage. In other words, "0" and "1" can be stored according to existence of a charge in the floating gate 42. This makes it possible to turn ON/OFF the first frame memory 24 and the second frame memory 25.

In this manner, in the liquid crystal display apparatus of the present embodiment, the first frame memory 24 and the second frame memory 25 have the same arrangement as that of an EEPROM (Electrical Erasable Programmable Read Only Memory). Therefore, the driving method for repeatedly writing data during one frame period mentioned in embodiment 6 can be applied by using the existing technique of EEPROM. Moreover, the arrangement of the first frame memory 24 and the second frame memory 23 which is same as that of EEPROM requires much time for writing and erasing, but it can improve memory hold capacity and reduce an area.

Here, the first frame memory 24 and the second frame memory 25 does not always have the above arrangement, so they may have any arrangement as long as they have the floating gate 42 and a function for storing "0" and "1", according to existence of a charge in the floating gate 42, for example.

[Embodiment 8]

Figure 21:
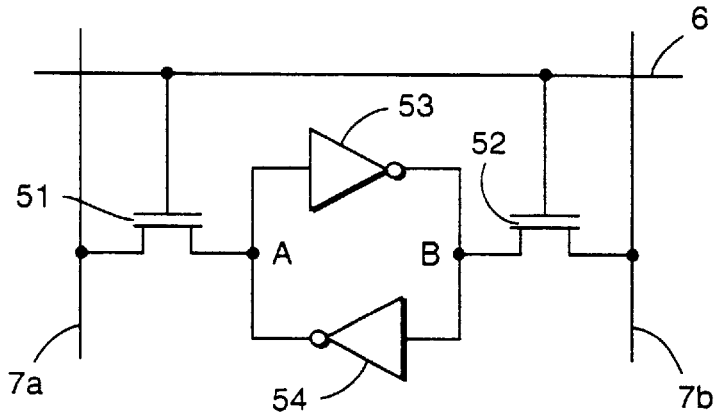
FIG. 21 is an equivalent circuit diagram which shows a first frame memory and a second frame memory of a liquid crystal display apparatus in still another embodiment of the present invention.
Figure 22:
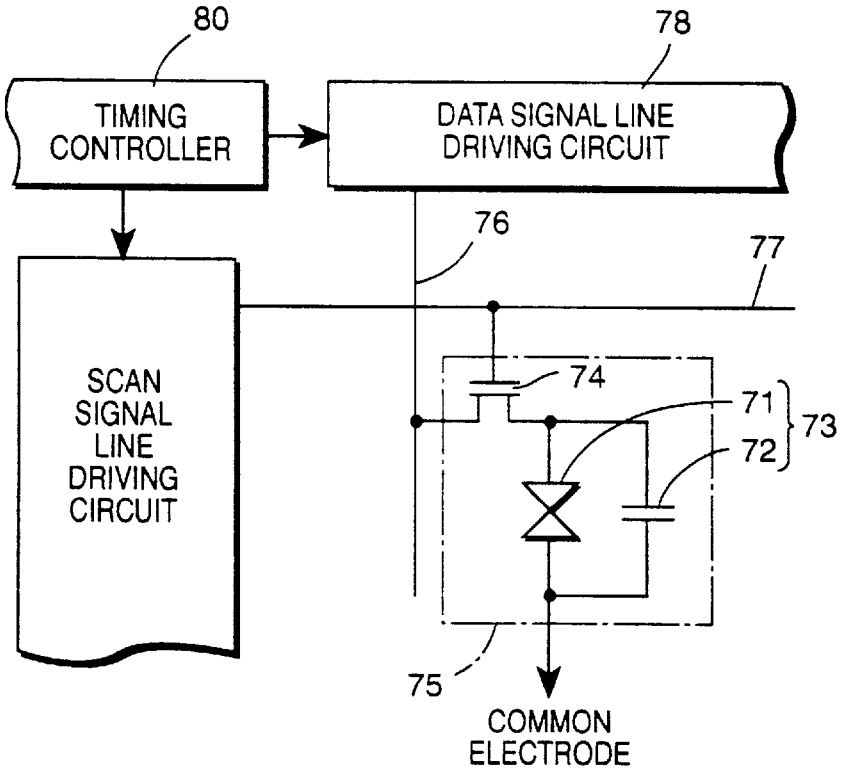
FIG. 22 PRIOR ART
FIG. 22 shows a conventional example and is a block diagram which shows a structure of a picture element in a liquid crystal display apparatus.
Figure 23:
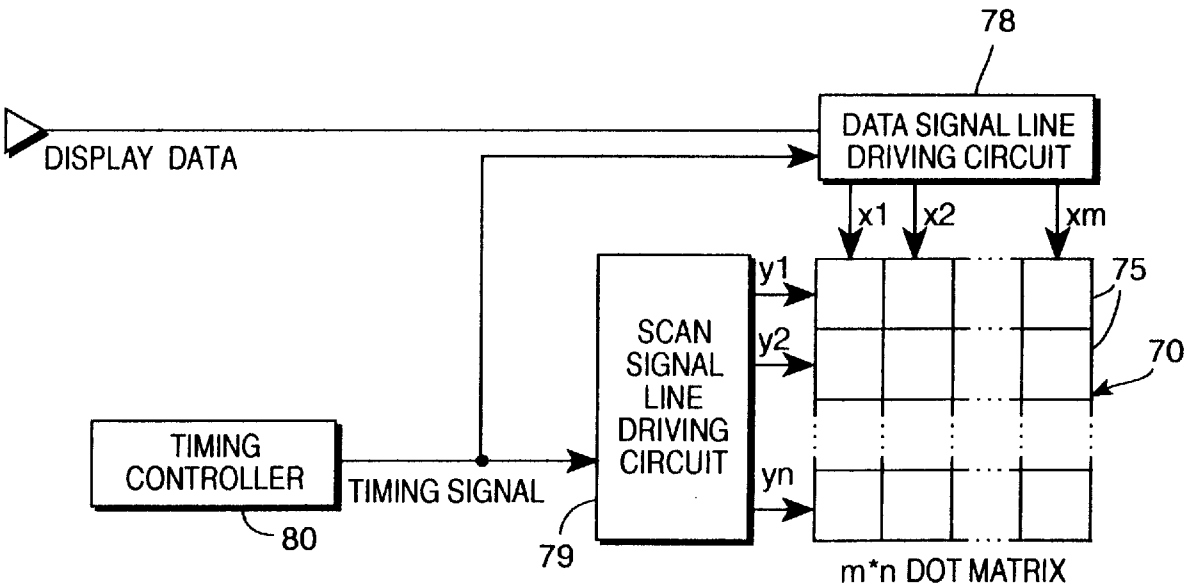
FIG. 23 PRIOR ART
FIG. 23 is a block diagram which shows an arrangement of the above liquid crystal display apparatus.
Figure 24:
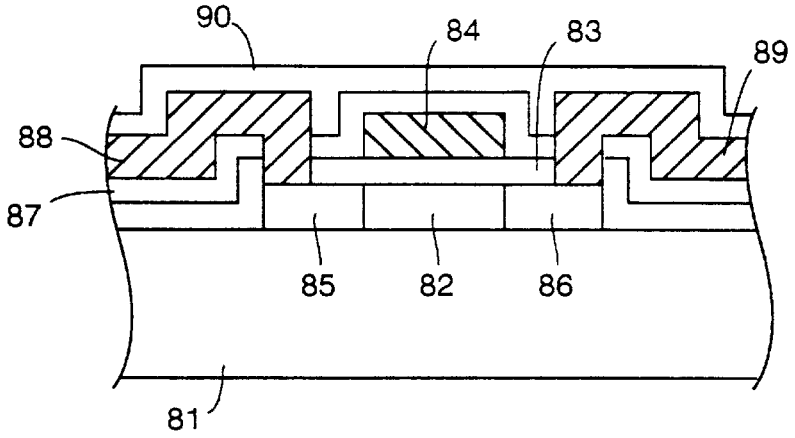
FIG. 24 PRIOR ART
FIG. 24 is a structural drawing which shows a picture element of the above liquid crystal display apparatus.
Figure 26:
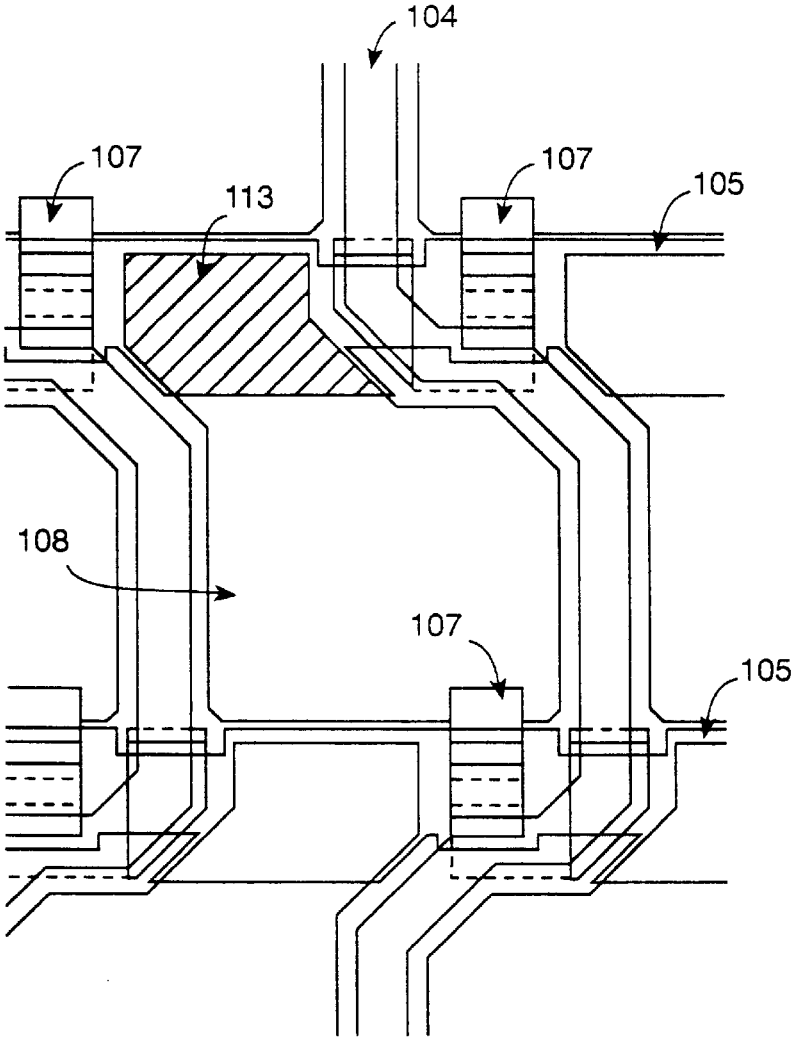
FIG. 26 is an explanatory drawing which shows an arrangement of a main section of a conventional picture element circuit.

The following will discuss another embodiment of the present invention referring to FIG. 21. Here, for convenience of explanation those members that have the same arrangement and functions, and that are described in the aforementioned embodiments, are indicated by the same reference numerals and the description thereof is omitted.

As shown in FIG. 21, in a frame memory in a liquid crystal display apparatus of the present embodiment, a memory call of the first frame memory 24 and the second frame memory 25 is composed of two selecting MOS transistors 51, 52 which are switching elements, and a first inverter 53 and a second inverter 54 which are connected between the selecting MOS transistors 51, 52.

The first inverter 53 and the second inverter 54 have a flip-flop arrangement such that an output of the first inverter 53 is connected to an input of the second inverter 54, and in a similar manner, an output of the second inverter 54 is connected to an input of the first inverter 54.

The other electrodes of the selecting MOS transistors 51, 52 are respectively connected to a bit line 7*a* and a bit line 7*b*, and gate electrodes are respectively connected to a word line 6. Therefore, the first frame memory 24 and the second frame memory 25 has the same arrangement as that of SRAM (Static Random Access Memory).

Next, a principle of an operation of the above memory cell will be explained.

First, when the selecting MOS transistors 51, 52 are turned ON, for, example, if "1" is supplied to the bit line 7*a* and "0" to the bit line 7*b*, "1" is written to a point A and "0" to a point B. Even when the selecting MOS transistors 51, 52 are turned OFF, "1" is maintained at the point A and "0" at the point B. Thereafter, when the selecting MOS transistors 51, 52 are again turned ON, "1" is read out to the bit line 7*a* and "0" to the bit line 7*b*.

As mentioned above, in the liquid crystal display apparatus of the present embodiment, the first frame memory 24 and the second frame memory 25 has the same arrangement as that of SRAM. Therefore, the driving method for repeating writing during one frame period which was explained in embodiment 1 can be applied by using the existing technique of SRAM. Moreover, the arrangement of the first frame memory 24 and the second frame memory 25 which is the same as that of SRAM can improve memory hold capacity.

As mentioned above, with the arrangements of embodiments 6 through 8, a MOS transistor and a driving circuit as well as the memory means are formed. As a result, it is possible to improve package efficiency and lower cost.

In addition, an auxiliary capacity of each picture element can be eliminated or a capacity value of the auxiliary capacity can be reduced. For this reason, an aperture ratio of a picture element can be improved and a size of the picture element circuit is reduced, thereby making it possible to improve a rate of acceptable products and refine an apparatus.

In addition, since same display data are repeatedly written to the same picture element during a period that new display data for one frame are stored, a data hold time required for a picture element is shortened and retention is improved. Therefore, also in the case where a polycrystal silicon TFT is used as a switching element, deficiency in OFF characteristic of the polycrystal silicon TFT can be made up and excellent quality of a picture can be secured.

In addition, the existing technique of DRAM, SRAM or EEPROM can be utilized.

In addition, since the MOS transistor is composed such that a polycrystal silicon thin film with a high driving capacity is used as a semiconductor layer, the memory means, the driving circuit and the switching element can be formed monolithically.

Deficiency in OFF characteristic of the MOS transistor using a polycrystal silicon thin film can be made up especially by writing display data a plurality of times from segment memory means to each picture element.

In addition, in the case each component element is formed at a process temperature of not more than 600° C., a glass substrate with a low price and a low melting point can be used, thereby making it possible to enlarge an apparatus and lower its cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An active matrix-type image display apparatus, comprising:

a plurality of data signal lines;

a plurality of scan signal lines which respectively intersect said data signal lines;

a picture element which is placed in a position which is surrounded by the adjoining data signal lines of said data signal lines and the adjoining scan signal lines of said scan signal lines, said picture element having an active element;

a data signal line driving circuit for driving said data signal lines;

a scan signal line driving circuit for driving said scan signal lines; and control means for controlling said scan signal line driving circuit and said data signal line driving circuit so that same display data are written to the picture element to be driven not less than twice within one frame period.

2. The active matrix-type image display apparatus as defined in claim 1, wherein said picture element section includes an active element and carrier mobility of said active element is more than 5 ($cm^2$/Vsec).

3. The active matrix-type image display apparatus as defined in claim 1, comprising:

a first active element being provided to said picture element so as to switch said picture element, a source electrode of said first active element being connected to a picture element electrode, a gate electrode of said first active element being connected to the scan signal line, a drain electrode of said first active element being connected to said data signal line; and a second active element being provided to said picture element so that a source electrode and a drain electrode are connected to the picture element electrode and a signal with opposite phase to a scan signal to be applied to said scan signal line is applied to a gate electrode, wherein if Cgs1 is a parasitic capacity between the gate and source electrodes of said first active element, Cgs2 is a parasitic capacity between the gate and source electrodes of said second active element, and Cgd2 is a parasitic capacity between the gate and drain electrodes of said second active element, said second active element has a size which holds a relationship: Cgs2+Cgd2=Cgs1.

4. The active matrix-type image display apparatus as defined in claim 1, comprising:

a first active element being provided to said picture element so that a source electrode is connected to a picture element electrode, a gate electrode is connected to said scan signal line, and a drain electrode is connected to said data signal line; and a second active element being provided to said picture element so that a source electrode is connected to the picture element electrode, a drain electrode is connected to said data signal line and a signal with opposite phase to the scan signal to be applied to said scan signal line is applied to a gate electrode, wherein said first and second active elements which are in a complementary relation have a size which holds a relationship: Cgs2=Cgs1, where Cgs1 is a parasitic capacity between the gate and source electrodes of said first active element, and Cgs2 is a parasitic capacity between the gate and source electrodes of said second active element.

5. The active matrix-type image display apparatus as defined in claim 1, comprising:

memory means for storing same display data to be written to the picture element to be driven not less than twice within one frame period, said memory means being placed outside said picture elements, wherein said memory means stores the display data by one frame, and the display data are read out from said memory means to said data signal line driving circuit by said control means.

6. The active matrix-type image display apparatus as defined in claim 5, wherein said memory means includes a DRAM configuration, an SRAM configuration or an EEPROM configuration.

7. The active matrix-type image display apparatus as defined in claim 5, further comprising:

MOS transistors, each of which is provided on each picture element as said active element, wherein said MOS transistors and picture elements which compose said data signal line driving circuit, said scan signal line driving circuit, and said memory means are formed by using a polycrystal silicon thin film as a semiconductor layer.

8. The active matrix-type image display apparatus as defined in claim 5, wherein a substrate of said image display apparatus is composed of a glass substrate having an electrical insulating characteristic and is formed at a process temperature of not more than 600° C.

9. The active matrix-type image display apparatus as defined in claim 5, wherein said memory means is divided into at least two memory means, first memory means and second memory means, said image display apparatus further comprising switching means for alternately switching between an operation for storing display data for new one frame into the first memory means and an operation for reading out display data for one frame, which have been stored in the second memory means, to said data signal line driving circuit, said control means controls the first memory means and the second memory means so that display data for one frame, which have been stored, are read out from the second memory means to said data signal line driving circuit not less than twice within a period for storing display data for new one frame into the first memory means.

10. The image active matrix-type display apparatus as defined in claim 9, wherein said first and second memory means include respective areas for storing red image display data, green image display data and blue image display data, which are included in one frame, whereby colour images are displayed by field sequential scan.

11. The active matrix-type image display apparatus as defined in claim 9, wherein said data signal line driving circuit, said scan signal line driving circuit, said memory means and said active elements are formed on one substrate.

12. The active matrix-type image display apparatus as defined in claim 5, wherein said memory means is divided into at two memory means, first memory means and second memory means, said image display apparatus further comprising switching means for alternately switching between an operation for storing display data for new one frame into the first memory means and an operation for reading out display data for one frame, which have been stored in the second memory means, to said data signal line driving circuit, said control means controls the first memory means and the second memory means so that the red image display data, green image display data and blue image display data corresponding to said display data are respectively read out from the second memory means to said data signal line driving circuit not less than twice per ⅓ frame period, which is obtained by dividing one frame into three, within a period for storing display data for new one frame into the first memory means.

13. The active matrix-type image display apparatus as defined in claim 5, wherein said data signal line driving circuit, said scan signal line driving circuit, said memory means and said active elements are formed on one substrate.

14. The active matrix-type image display apparatus as defined in claim 1, wherein said data signal line driving circuit, said scan signal line driving circuit and said active elements are formed on one substrate.

* * * * *